US011751649B2

(12) United States Patent
Seiders et al.

(10) Patent No.: US 11,751,649 B2
(45) **Date of Patent: *Sep. 12, 2023**

(54) TOTE BAG

(71) Applicant: YETI Coolers, LLC, Austin, TX (US)

(72) Inventors: Roy Joseph Seiders, Austin, TX (US); Dustin Bullock, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/526,896

(22) Filed: Nov. 15, 2021

(65) Prior Publication Data

US 2022/0071360 A1 Mar. 10, 2022

Related U.S. Application Data

(63) Continuation of application No. 17/224,881, filed on Apr. 7, 2021, now Pat. No. 11,172,741, which is a (Continued)

(51) Int. Cl.
*A45C 3/00* (2006.01)
*A45C 13/00* (2006.01)
(Continued)

(52) U.S. Cl.
CPC ..... *A45C 3/001* (2013.01); *A45C 13/008* (2013.01); *A45C 13/103* (2013.01); *A45C 13/36* (2013.01); *A45F 3/02* (2013.01); *A45C 2003/008* (2013.01)

(58) Field of Classification Search
CPC ..... A45C 3/001; A45C 3/04; A45C 13/008; A45C 13/36; A45C 13/02; A45C 11/20;
(Continued)

(56) References Cited

U.S. PATENT DOCUMENTS 2,960,136 A 11/1960 Ziff
3,121,452 A 2/1964 Hyman
(Continued)

FOREIGN PATENT DOCUMENTS

CN 1533868 A 10/2004
CN 2855170 Y 1/2007
(Continued)

OTHER PUBLICATIONS

JP2000106933ATranslation (Year: 2000).*
(Continued)

*Primary Examiner* — Jes F Pascua
*Assistant Examiner* — Nina K Attel
(74) *Attorney, Agent, or Firm* — Banner & Witcoff, Ltd.

(57) ABSTRACT

A tote bag including an outer shell comprising a sidewall defining a top, an opening, a front, and a back, wherein the outer shell is flexible, and wherein the outer shell comprises a seam. A plurality of straps, wherein the plurality of straps is attached to the outer shell. A base defining a bottom of the bag, wherein the outer shell and the base form a storage compartment, and wherein the opening is configured to allow access to the storage compartment, the storage compartment further comprising, an inner pocket attached to an interior of the bag comprising a zipper, wherein the zipper is configured to open and close the inner pocket.

27 Claims, 22 Drawing Sheets

Related U.S. Application Data continuation of application No. 17/093,173, filed on Nov. 9, 2020, now Pat. No. 11,363,865, which is a continuation of application No. 15/903,867, filed on Feb. 23, 2018, now Pat. No. 10,827,808.

(60) Provisional application No. 62/463,308, filed on Feb. 24, 2017.

(51) Int. Cl.
*A45F 3/02* (2006.01)
*A45C 13/36* (2006.01)
*A45C 13/10* (2006.01)

(58) Field of Classification Search
CPC .... A45C 3/00; B65D 81/389; B65D 81/3897; B65D 81/388; B65D 81/3888
USPC ..... 383/6, 108, 110, 105, 109, 121, 121.1, 383/122
See application file for complete search history.

(56) References Cited

U.S. PATENT DOCUMENTS

| | | | | |
|---|---|---|---|---|
| 4,117,874 | A | 10/1978 | Berenguer | |
| 4,180,111 | A | 12/1979 | Davis | |
| 4,378,866 | A | 4/1983 | Pelavin | |
| 4,592,091 | A | 5/1986 | Italic | |
| 4,610,286 | A | 9/1986 | Italic | |
| 4,826,060 | A * | 5/1989 | Hollingsworth | A45F 3/02 383/110 |
| 5,632,558 | A * | 5/1997 | Baker | B65D 37/00 206/83.5 |
| D491,354 | S * | 6/2004 | Chapelier | D3/246 |
| D497,050 | S * | 10/2004 | Grambush | D3/246 |
| 7,320,411 | B1 * | 1/2008 | Shenosky | A45C 3/04 383/98 |
| 2005/0011520 | A1 | 1/2005 | Rowe | |
| 2005/0117817 | A1 * | 6/2005 | Mogil | A45C 11/20 383/110 |
| 2007/0137960 | A1 | 6/2007 | Redzisz | |
| 2008/0083629 | A1 | 4/2008 | Soucie | |
| 2010/0270342 | A1 | 10/2010 | Barthel | |
| 2013/0133795 | A1 | 5/2013 | Zhou et al. | |
| 2015/0201722 | A1 * | 7/2015 | Brouard | A45C 1/02 150/107 |
| 2015/0225164 | A1 * | 8/2015 | Seiders | A45C 3/001 220/592.25 |
| 2015/0246751 | A1 * | 9/2015 | Spivack | A45C 13/02 383/38 |
| 2016/0083147 | A1 * | 3/2016 | Mauro | A45C 13/103 383/22 |
| 2017/0099920 | A1 * | 4/2017 | Bailey | A45C 3/04 |
| 2018/0242701 | A1 | 8/2018 | Seiders et al. | |
| 2019/0200715 | A1 | 7/2019 | Peris et al. | |
| 2019/0298017 | A1 | 10/2019 | Potts et al. | |

FOREIGN PATENT DOCUMENTS

| | | | |
|---|---|---|---|
| CN | 201011906 | Y | 1/2008 |
| CN | 201409565 | Y | 2/2010 |
| CN | 301447931 | S | 1/2011 |
| CN | 202760433 | U | 3/2013 |
| CN | 204499726 | U | 7/2015 |
| CN | 304154180 | | 6/2017 |
| CN | 304181831 | | 6/2017 |
| CN | 304207295 | | 7/2017 |
| CN | 206760980 | U | 12/2017 |
| DE | 4020162036690001 | | 10/2017 |
| DE | 202019105022 | U1 | 9/2019 |
| EM | 0017254660003 | S | 7/2010 |
| EP | 2461711 | A1 | 6/2012 |
| EP | 3020303 | A1 | 5/2016 |
| EP | 003811264-0010 | | 3/2017 |
| EP | 003841857-0002 | | 4/2017 |
| EP | 004122430-0001 | | 8/2017 |
| EP | 004162337-0001 | | 9/2017 |
| EP | 004162337-0002 | | 9/2017 |
| EP | 004162337-0003 | | 9/2017 |
| GB | 968422 | A | 9/1964 |
| GB | 2225103 | A | 5/1990 |
| JP | 2000106933 | A * | 4/2000 |
| JP | 2000106933 | A | 4/2000 |
| JP | 1123533 | S | 10/2001 |
| JP | 2004073820 | A | 3/2004 |
| KR | 200177739 | Y1 | 5/2000 |
| WO | 17079315 | A1 | 5/2017 |
| WO | 17088278 | A1 | 6/2017 |
| WO | 17132598 | A1 | 8/2017 |

OTHER PUBLICATIONS

United States District Court Western District of Texas, Austin Division, "Second Amended Complaint", *YETI Coolers, LLC* v. *RTIC Outdoors, LLC; and Corporate Support & Fulfillment, LLC*, Case 1:21-cv-00214-RP, Document 33, filed Dec. 17, 2021, 489 pages.

United Stated District Court Western District of Texas, Austin Division, "Answer of Defendants RTIC Outdoors, LLC and Corporate Support & Fulfillment, LLC to YETI's Second Amended Complaint, Jury Trial Demanded", *YETI Coolers, LLC* v. *RTIC Outdoors, LLC; and Corporate Support & Fulfillment, LLC*, Case 1:21-cv-00214-RP, Document 34, filed Jan. 3, 2022, 92 pgs.

Exhibits C-8, D-6, E-6, and F-6 "Filson Rugged Twill Bucket Bag", U.S. District Court Western District of Texas, "Defendants RTIC Outdoors, LLC's and Corporate Support & Fulfillment, LLC's Invalidity Contentions", *YETI Coolers, LLC* v. *RTIC Outdoors, LLC*, Case No. 1:21-cv-00214, Jan. 17, 2022, pp. 486-491, 568-582, 649-661, and 722-735.

Mar. 24, 2022—(CN) Board Opinion—App. No. 201810157521.6.

United States District Court Western District of Texas Austin Division, "Defendants RTIC Outdoors, LLC's and Corporate Support & Fulfillment, LLC's Invalidity Contentions", *YETI Coolers, LLC* v. *RTIC Outdoors, LLC and Corporate Support & Fulfillment, LLC*, Case No. 1:21-cv-00214, Jury Trial Demanded, filed Jan. 17, 2022, 3173 pages.

Jun. 14, 2022—(CN) Board Opinion—App. No. 201810157521.6.

Dec. 8, 2022—(EP) Extended Search Report—App. No. 22184900.3.

Nov. 11, 2022—(CN) Board Decision—App. No.201810157521.6.

United States District Court Middle District of Florida, Tampa Division, "Complaint for Damages and Injunctive Relief, and Demand for a Jury Trial", *YETI Coolers, LLC* v. *Bote, LLC*, Case 8:23-cv-00370, Document 1, filed Feb. 17, 2023, 125 pages.

United States District Court Middle District of Florida, Tampa Division, "Defendant's Answer and Affirmative Defenses to Plaintiffs Complaint for Damages and Injunctive Relief (Doc. 1), and Defendant's Demand for a Jury Trial ", *YETI Coolers, LLC* v. *Bote, LLC*, Case 8:23-cv-00370-WFJ-MRM, Document 38, filed Apr. 20, 2023, 46 pages.

* cited by examiner

TOTE BAG

CROSS REFERENCE TO RELATED APPLICATION

This application is a continuation of U.S. application Ser. No. 17/224,881, filed Apr. 7, 2021, which is a continuation of U.S. application Ser. No. 17/093,173, filed Nov. 9, 2020, which is a continuation of U.S. application Ser. No. 15/903,867, filed Feb. 23, 2018, now U.S. Pat. No. 10,827,808 which claims priority to U.S. Provisional Application Ser. No. 62/463,308, filed Feb. 24, 2017.

FIELD

The present disclosure relates generally to non-rigid and portable tote bags or packs useful for carrying or transporting various items by hand-carrying or placing the tote over the shoulder via tote straps or handles.

BACKGROUND

A tote or carry bag can be a means for an individual to carry or transport various items to include large or bulky objects. Tote bags may in certain instances be easier to carry than luggage and can be made of sturdy cloth, leather, heavy canvas, plastics, etc. A tote bag may have an unsecured opening and can include large parallel shoulder straps attached to the sides of the bag.

SUMMARY

This Summary provides an introduction to some general concepts relating to this invention in a simplified form that are further described below in the Detailed Description. This Summary is not intended to identify key features or essential features of the invention.

In one aspect, an example tote bag may provide an individual with an easily portable bag that can be extremely durable, water resistant, anti-microbial, and easily cleaned by flushing with water from a hose or other means. Other aspects of the disclosure herein may relate to tote bags and methods of making tote bags having one or more of (1) an outer shell defining a sidewall, (2) an inner bottom liner, (3) a storage compartment formed by the outer shell and the inner bottom liner, (4) an opening configured to allow access to the storage compartment, and (4) a semi-rigid base configured to keep the tote bag upright with or without contents in the storage compartment.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

FIG. 14B-1 illustrates a front view of the tote bag with a view of the placement of the pocket on the interior of the tote bag and FIG. 14B-2 depicts the dimensions of the interior pocket of the tote bag.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "front," "frontside," "back," "backside," "top," "base," "bottom," "side," "opposite," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1:
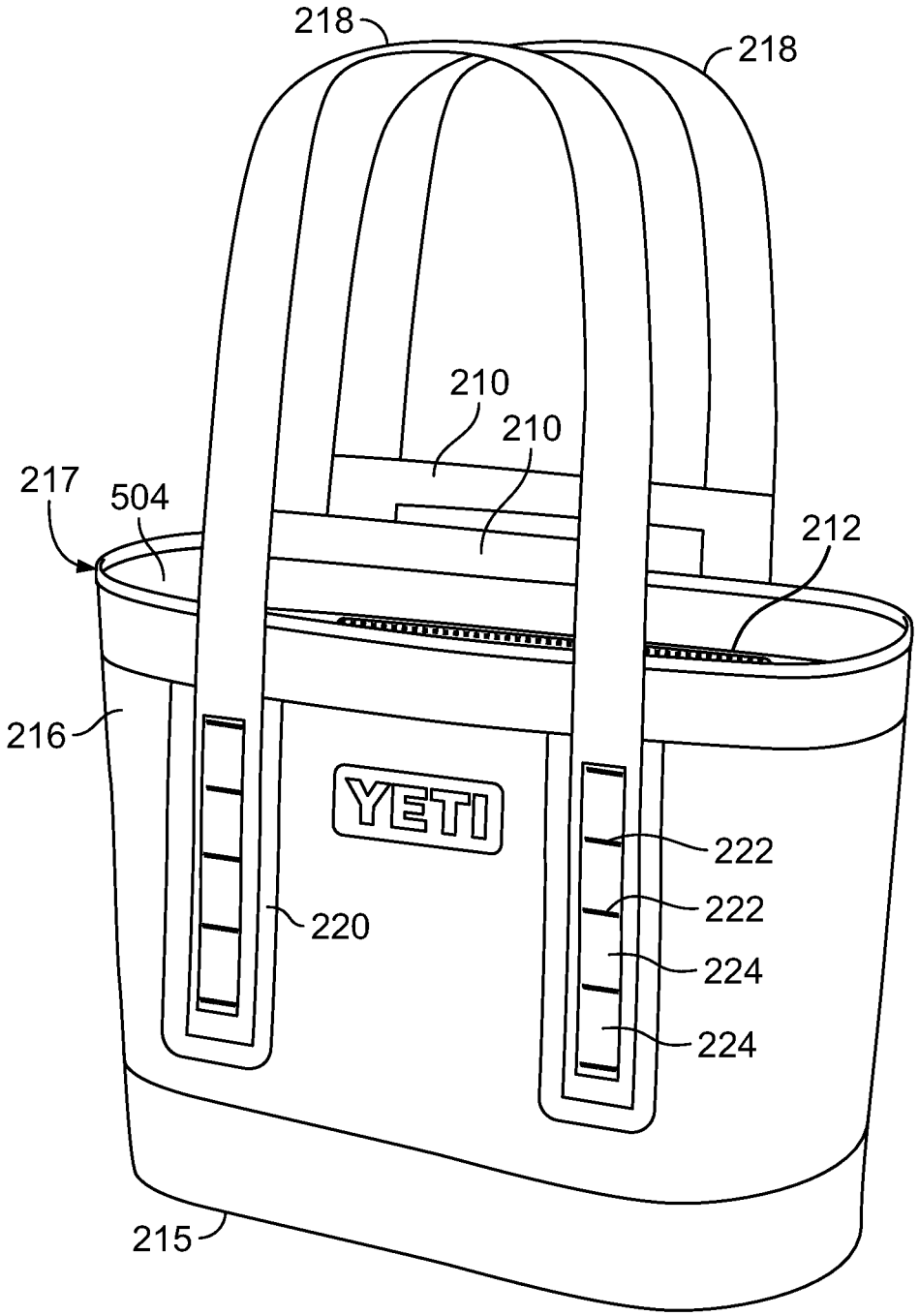
FIG. 1 shows a right front perspective view of an example tote bag in accordance with an aspect of the disclosure.
Figure 2A:
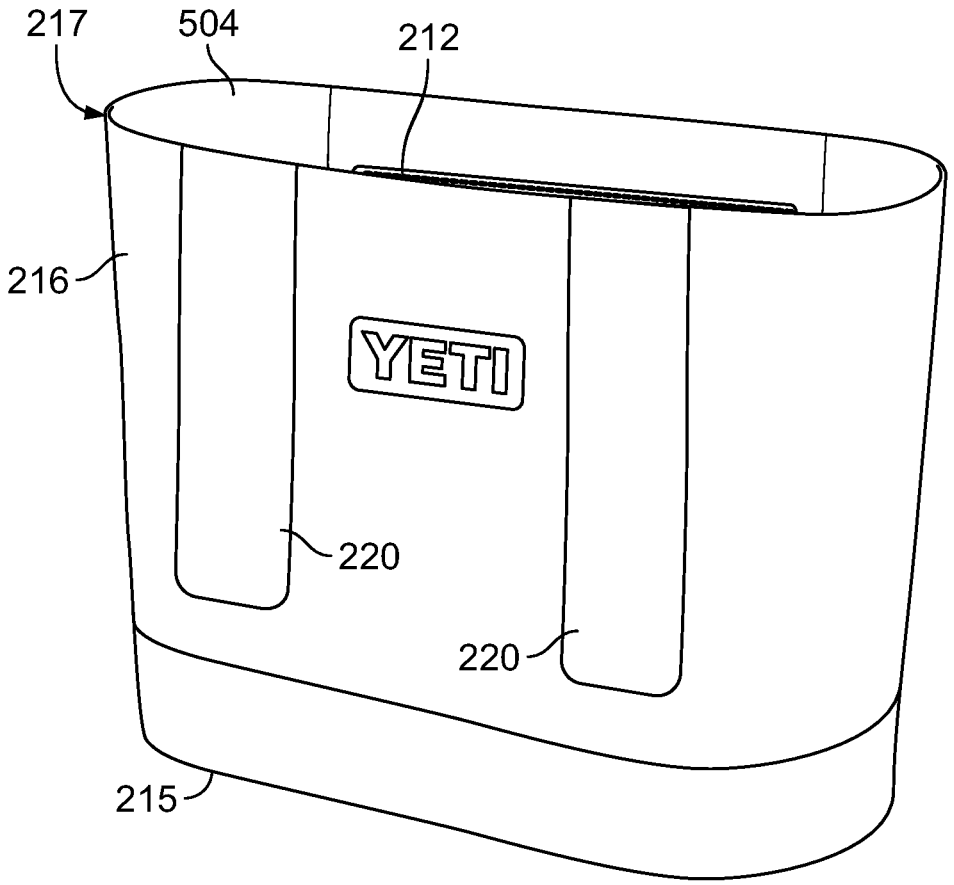
FIG. 2A shows a right front perspective view of an example tote bag of FIG. 1 without the straps.
Figure 2B:
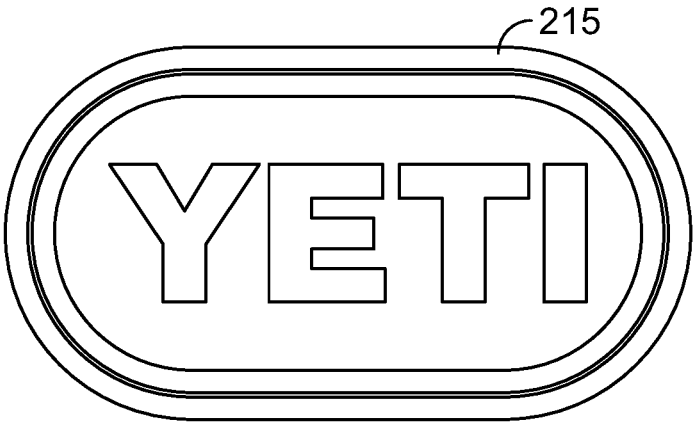
FIG. 2B shows a bottom perspective view of the example tote bag of FIG. 1.
Figure 3:
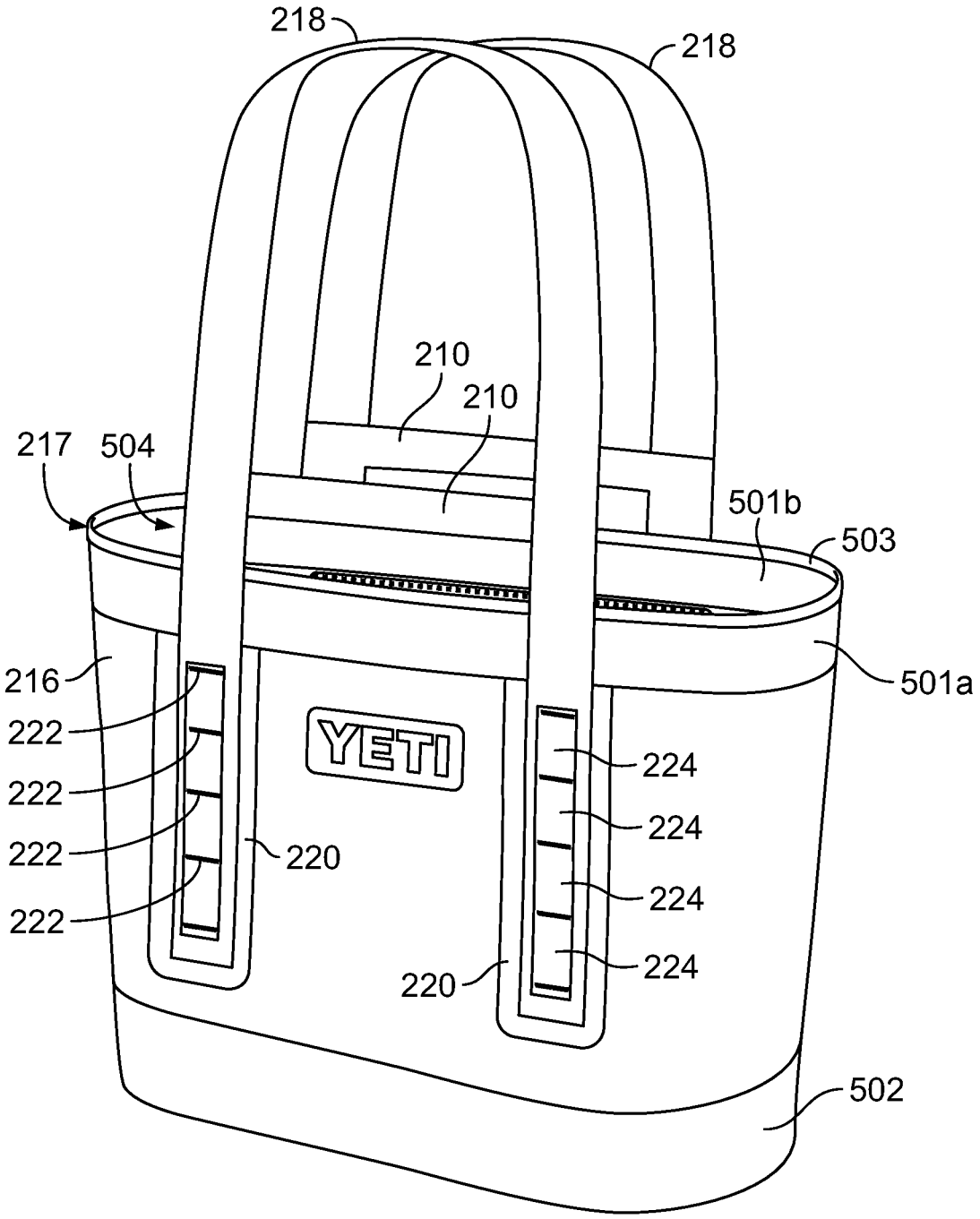
FIG. 3 shows another right front perspective view of an example tote bag of FIG. 1.
Figure 14A:
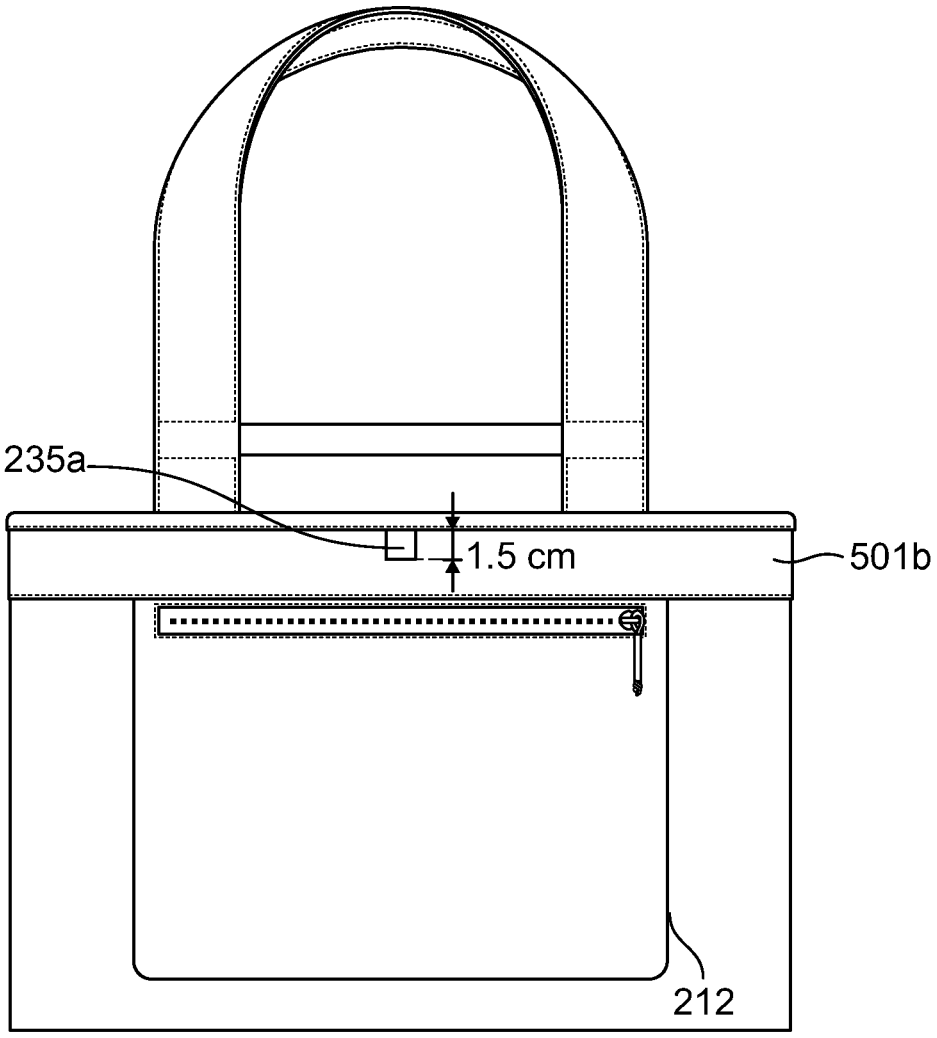
FIG. 14A is a cross-sectional view of the interior of the example tote bag of FIGS. 12A-B.
Figures 1, 2, 14B:
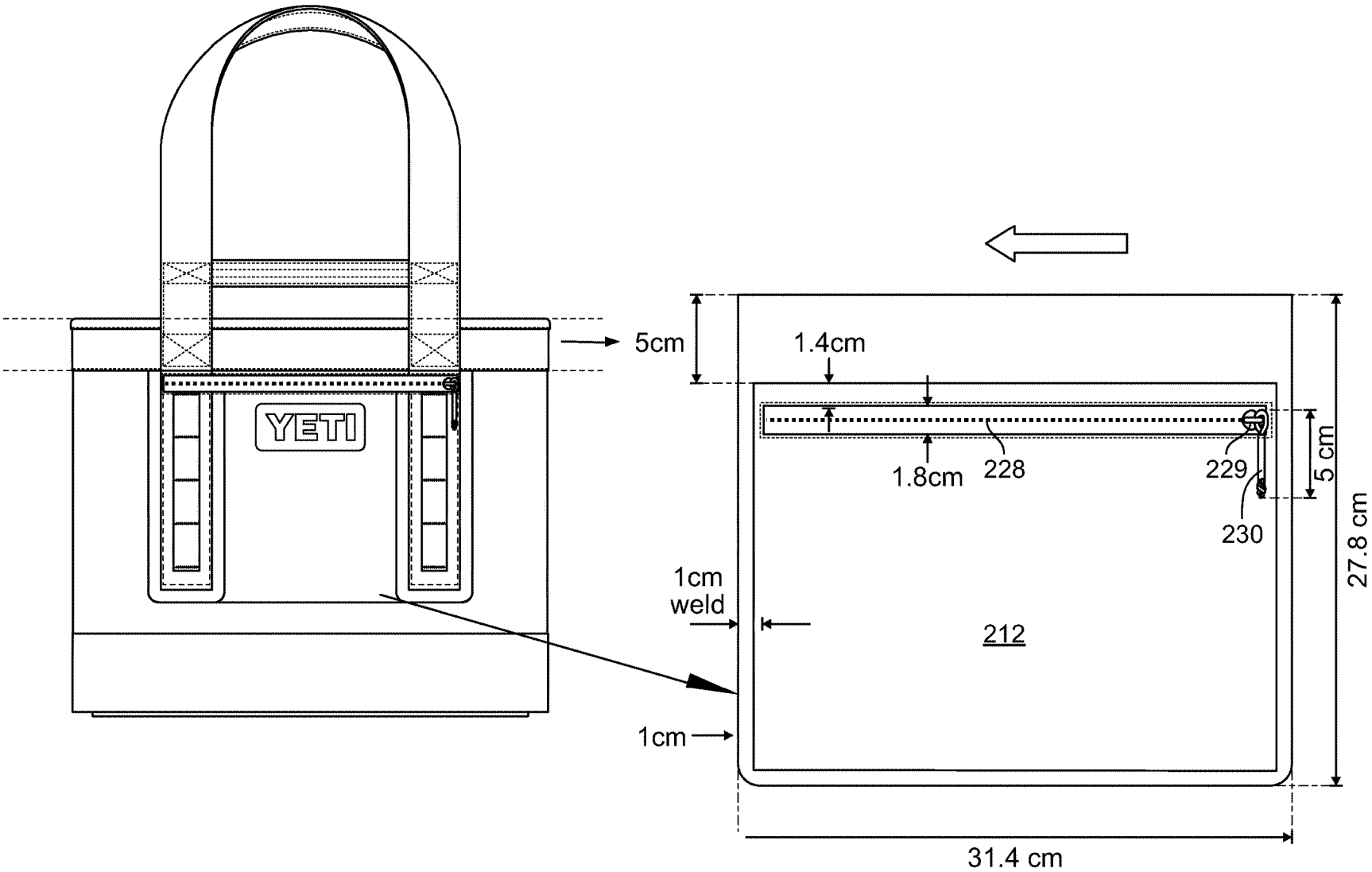
Figure 14C:
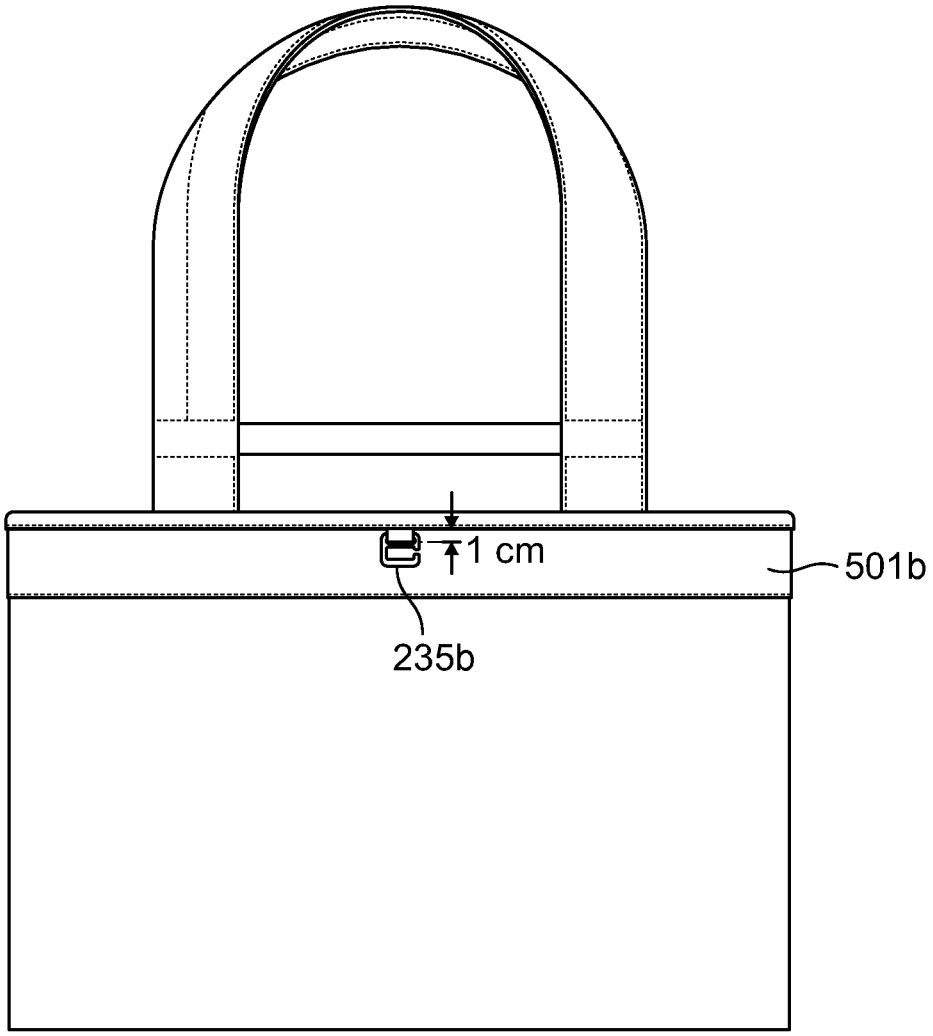
FIG. 14C is another cross-sectional view of the interior of the example tote bag of FIGS. 12A-B.

FIGS. 1-3 depict an exemplary tote bag that can be configured to carry or contain various items. The tote bag can generally include an outer shell 216, shoulder straps 218, hand straps 210, a base 215, an opening, and a storage compartment 504. As shown in FIGS. 1 and 2A the outer shell 216 forms a storage compartment 504 for receiving the desired contents therein. FIG. 2B depicts a semi-rigid base 215 that is configured to keep the tote bag upright with or without contents in the storage compartment 504. The semi-rigid base can be configured to be in the shape of an oval, ellipsoid, rectangle, circle, square, etc. As shown in FIG. 1, various handles, straps, and webs (e.g. 218, 210) and MOLLE loops, and stitching seams or bar tacks (e.g. 224, 222) can also be included on the tote bag for carrying, holding, or securing the tote bag, or for securing other items to the tote bag. FIGS. 1 and 2A also depict a pocket 212 attached to the interior of the storage compartment 504 formed by the outer shell 216. Also shown in FIGS. 1 and 2A is a single seam 217 wherein the outer shell is fused or connected to form a single solitary component.

The tote bag can be configured to include an opening to be closed with a zipper or a waterproof zipper. In such a configuration, the tote bag is substantially water resistant and can keep desired contents dry for an extended period of time during wet conditions. It is also contemplated that the opening can include various sealing devices in addition to a waterproof zipper, for example, Velcro, buttons, snaps, buckles, zippers, excess material that is folded multiple times to form a seal such as a roll-down seal, seals, metal or plastic clamps and combinations thereof could be used to seal the opening. In one example, the tote bag can also be designed to maintain water inside the storage compartment 504, and the tote bag can be configured to be water "resistant" from the outside in. In other words, the tote bag can be formed "water tight" inside the outer shell 216 and bottom inner liner 219, and configured to transport water or other liquid. In another example, the tote bag storage compartment is configured to include drain holes, wherein the drain holes penetrate the outer shell, and wherein the drain holes allow fluid to drain out of the storage compartment. Such a configuration allows a user to easily wash or rinse out the tote bag storage compartment with a hose, power washer, or other cleaning device, and the water is allowed to drain out of the tote bag.

FIG. 2A also depicts reinforcing patches 220, which in certain examples can be welded or fused to the outer shell 216 and the straps 218, which can in certain examples can be connected to the outer shell by binding the straps to the patches 220. In one example, the binding material can be nylon. The outer shell and the inner liner can be manufactured from materials that are antimicrobial or anti-fungal. The tote bag can also be manufactured from materials that are water resistant or water proof to keep the contents stored therein substantially dry.

FIG. 3 depicts a front right view of an exemplary tote bag. The tote bag includes shoulder straps 218 and hand straps 210. Also depicted is a top binding 503 and bottom tape fabric 502. Also visible is the single outer shell seam 217, outer top tape fabric 501*a* and inner top tape fabric 501*b*. Straps 218 further include MOLLE loops 224 and stitching seams 222. However, the MOLLE loops 224 do not necessarily need to be MOLLE and could be configured differently in different shapes and sizes depending on their desired usage. The straps 218 and MOLLE loops 224 can be stitched to outer shell reinforcing patch 220 and the reinforcing patch 220 is welded to the outer shell 216.

Figure 4B:
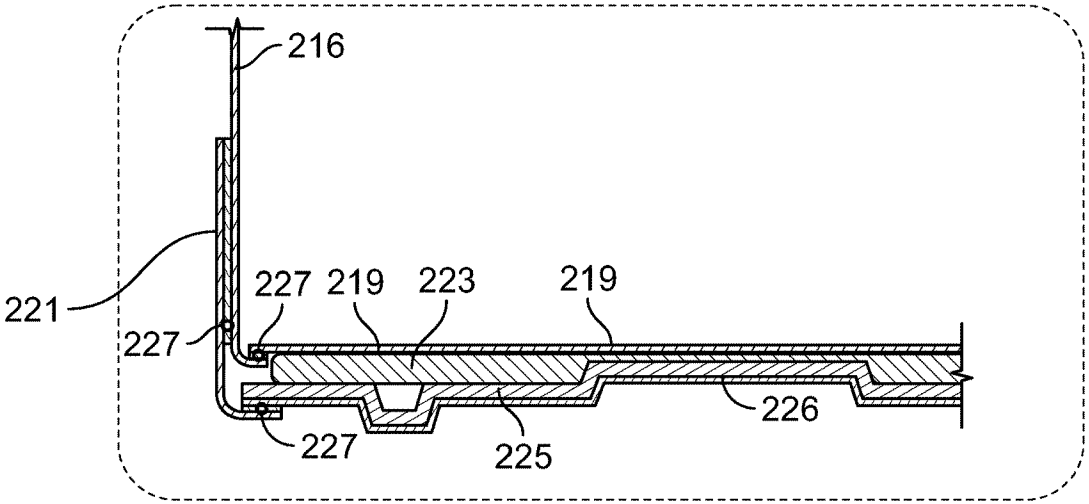
FIGS. 4A-B show a bottom perspective view of the example tote bag of FIG. 1 and illustrate a schematic of an enlarged portion of a cross-sectional view of the semi-rigid base.
Figure 4A:
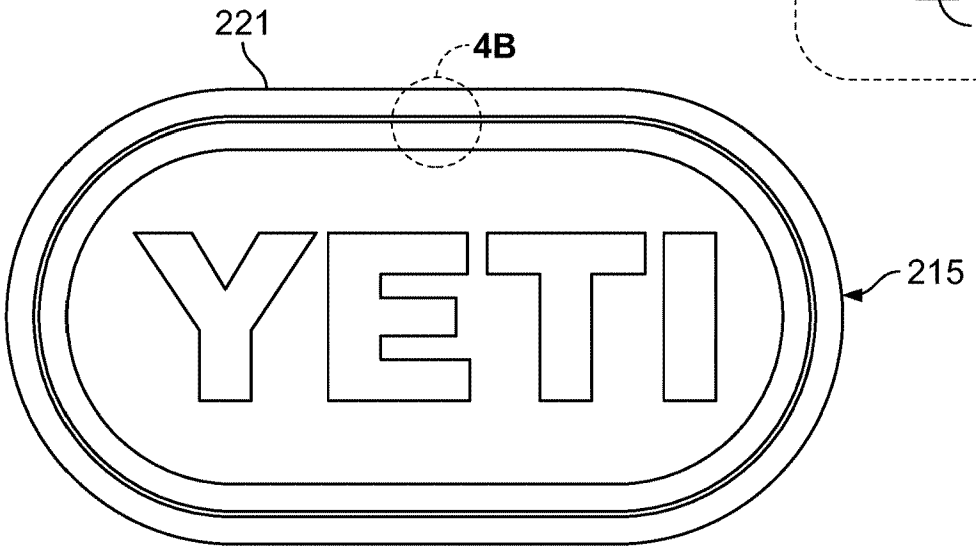

FIGS. 4A-B depict a bottom view of the tote bag and illustrates a schematic of an enlarged portion of a cross-sectional view of the construction of the semi-rigid base. As shown in FIGS. 4A-B, the tote bag may include a base 215 and a TPU coated nylon bottom tape fabric 221 that is welded to the outer shell 216 and the base outer shell 226. The bottom inner liner 219 is also welded to the outer shell 216. The welds 227 are depicted in FIGS. 4A-B. In addition, a compression molded EVA with TPU coated nylon laminate 225 and a PE foam base 223 are layered in between the bottom inner liner 219 and the base outer shell 226. The base 215 can provide structural integrity and support to the tote bag when the tote bag is placed onto a surface and keeps the bag upright with or without contents inside the storage compartment.

In one particular example, a portion of the base can be formed by injection molding. Additionally, in one example, the foam base 223, which can be formed from EVA foam, can be secured to the bottom of inner bottom liner 219 by lamination or by polymer welding (e.g. RF welding), stitching, or adhesives. The base outer shell 226 can be secured to the compression molded EVA 225 by polymer welding (e.g. RF welding), stitching, or adhesives. Similarly, the compression molded EVA 225 can be secured to the foam base 223 by polymer welding (e.g. RF welding), stitching, or adhesives.

Figure 5B:
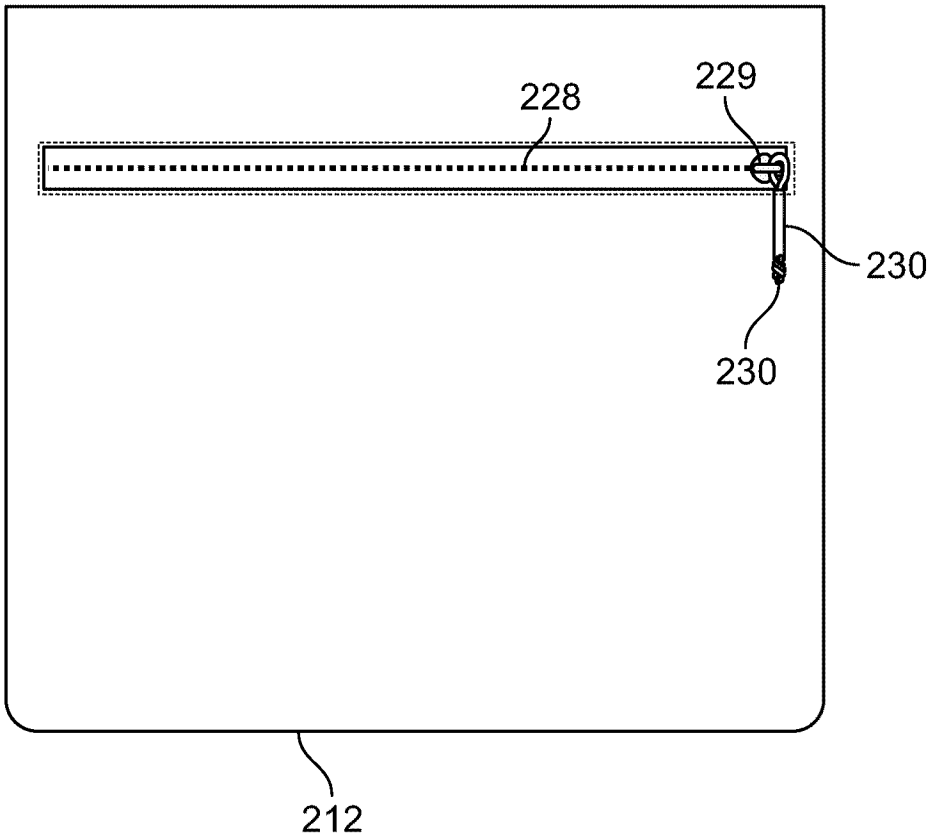
FIG. 5B illustrates an enlarged view of the inner pocket with a zipper.
Figure 5A:
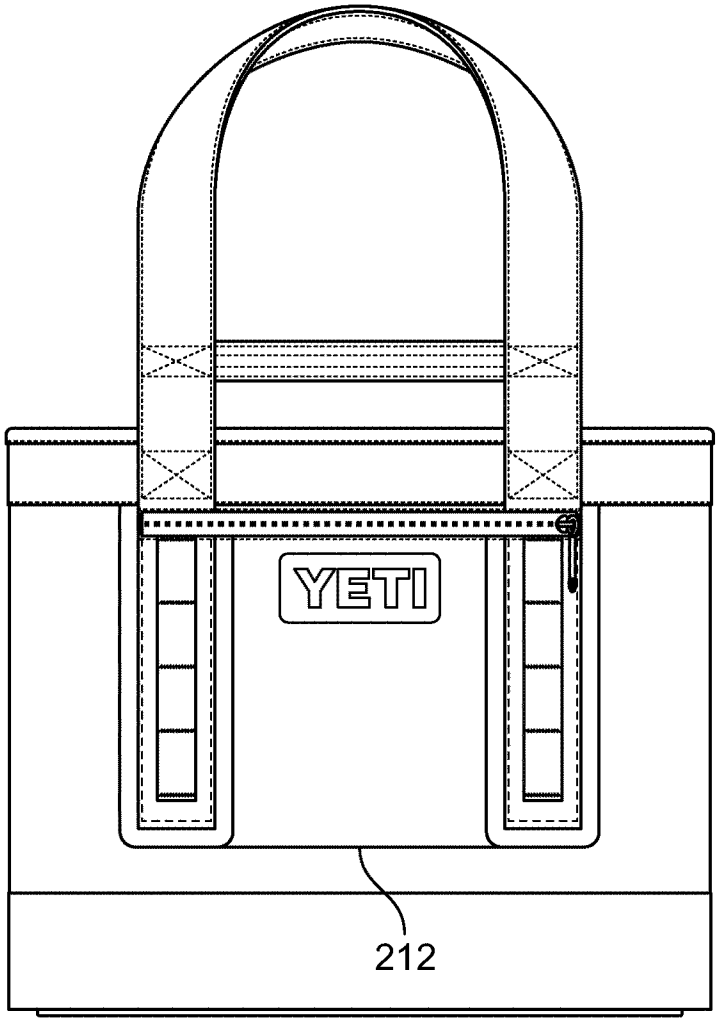
FIG. 5A shows a transparent front-perspective view of the example tote bag of FIG. 1 showing the placement of the inner pocket 212 on the interior of the tote bag.

In one example, as shown in FIGS. 5A-B, the tote bag includes a storage compartment 504 that includes a first pocket 212. The first pocket 212 may be welded to the inside of the tote bag inside the storage compartment. In one example, the first pocket 212 includes a zipper 228, a zipper slider 229, and a paracord puller 230 with a heat shrinking tube. The pull may also be formed of a cloth, string, or rope. The puller may also be a metal, alloy, composite, ceramic, or plastic, along with other suitable materials. In another example, the zipper 228 is waterproof, and first pocket is configured to be waterproof when the zipper is closed. In one particular example, the waterproof zipper can be constructed with plastic or other non-metallic teeth to prevent injury when retrieving items from the first pocket 212. It is contemplated that the first pocket can include various sealing devices in addition to a waterproof zipper, for example, hook and loop, buttons, snaps, buckles, zippers, excess material that is folded multiple times to form a seal such as a roll-down seal, seals, metal or plastic clamps and combinations thereof. The pocket may also be constructed of a transparent material such that the user can see the contents inside the pocket without opening the zipper. In yet another embodiment, the tote bag includes a second pocket directly opposite the first pocket, inside the storage compartment of the tote bag. The second pocket may be welded to the storage compartment and the second pocket may also be constructed of a transparent material to see the contents inside the pocket. Both the first and the second pockets may be constructed of a mesh material that allows a user to easily visualize the contents of the pocket. Both the first and second pocket may be secured or attached to the storage compartment 504 by using any other method disclosed herein or any known method, e.g., polymer welding, stitching, or other adhesive.

Various materials may be used to construct the components of the disclosed tote bag. In one particular embodiment, as shown in FIGS. 2A, 2B, 3, 4, and 5, the tote bag components are constructed of the respective materials outlined in Table 1 below. In one example, the tote bag is generally foldable or collapsible down to the semi-rigid base for easy storage and transport.

TABLE 1

| MATERIALS | | | | |
|---|---|---|---|---|
| COMPONENT | DESCRIPTION | LOCATION | COLOR | NOTES |
| 212 Firstp ocket | 1680D Nylon with double sided TPU, Opaque, Two Color | BODY | MEDIUM GREY/ SEA FOAM | 420D TEXTURE ON BOTH SIDES |
| 502 Bottom tape fabric | 1680D Nylon with double sided TPU, Opaque, One Color | BODY | DARK GREY | 420D TEXTURE ON EXTERIOR SURFACE |
| 210 Hand strap | 1680D Nylon Uncoated | BODY | BLACK | |
| 220 Patch or logo | 1680D Nylon with double sided TPU, Opaque, One Color | BODY | DARK GREY | 420D TEXTURE ON EXTERIOR SURFACE |
| 503 Top binding | 420D Nylon | TOP BINDING | BLACK | |
| TAPES | | | | |
| COMPONENT | DESCRIPTION | LOCATION | COLOR | |
| 228 Zipper | #8 RC ZIPPER | INSIDE ORG. POCKET | BLACK | |
| 229 Zipper slider | #8 RC ZIPPER SLIDER | INSIDE ORG. POCKET | BLACK | |
| 230 Zipper puller | PARA-CORD PULLER WITH HEAT SHRINK TUBE | INSIDE ORG. POCKET | BLACK | |
| INSULATION AND FILLERS | | | | |
| COMPONENT | DESCRIPTION | LOCATION | COLOR | |
| 226 Base outer shell | 3 MM EVA, (WITH 1680D NYLON LAMINATE) | COMPRESSION MOLDED BASE | DARK GREY | |
| 223 Foam base | 3 MM PE SPONGE FOAM | BASE | WHITE | |
| WEBBINGS | | | | |
| COMPONENT | DESCRIPTION | LOCATION | COLOR | |
| 218 Shoulder strap | 50 MM X 1.5 MM NYLON WEBBING | HANDLES AND TAPE | BLACK | |
| 210 Hand strap | 25 MM X 2 MM NYLON WEBBING | HANDLES | BLACK | |
| 224 MOLLE loop | 25 MM X 1 MM NYLON WEBBING | HITCHPOINT GRID | BLACK | |

Figure 6B:
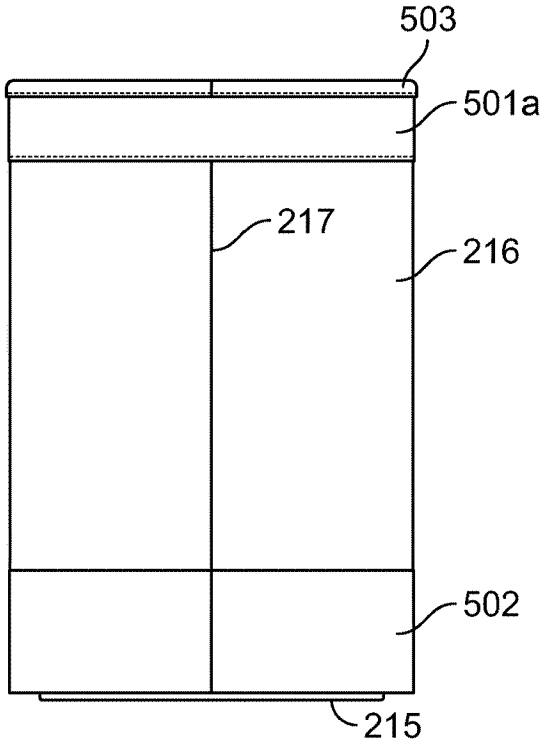
FIG. 6B shows a side perspective view of the example tote bag of FIG. 6A.
Figure 6A:
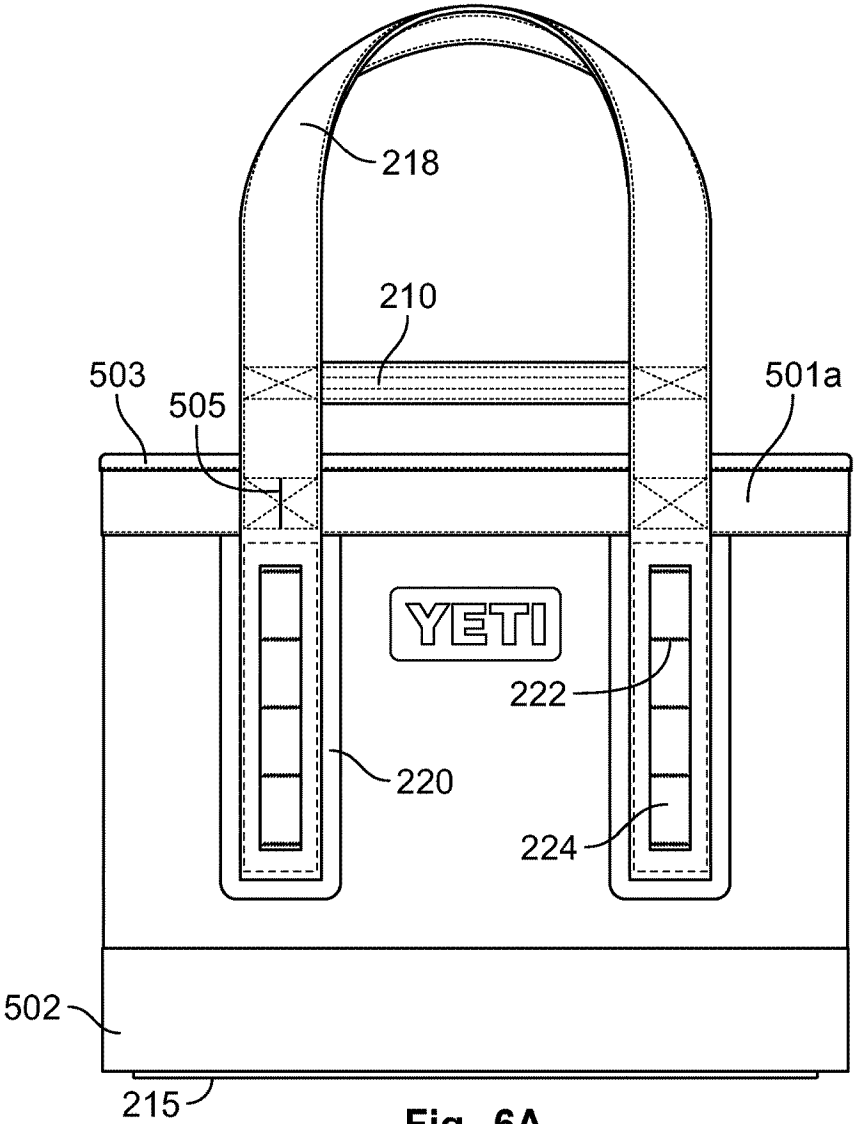
FIG. 6A shows a front view of another exemplary tote bag.

In one example, as shown in FIGS. 6A and 6B, the tote bag includes shoulder straps 218 and hand straps 210. The shoulder straps may also include MOLLE loops 224. Additionally, as shown in FIGS. 6A and 6B, webbing formed as MOLLE loops 224 can be sewn onto the straps 218 and 210 on the front and back of the tote bag. The MOLLE loops 224 can be used to attach items (e.g., carabineers, dry bags) to the tote bag. The hand straps 210 can also provide the user with another option for securing the tote bag to a structure.

In another example, the shoulder strap 218, hand strap 210, and MOLLE loops 224 can be constructed of nylon webbing. Other materials may include polypropylene, neoprene, polyester, Dyneema, Kevlar, cotton fabric, leather, plastics, rubber, or rope. The shoulder strap 218 and hand strap 210 can be attached to the outer shell 216 by stitching, adhesive, or polymer welding. Further, as shown in FIG. 6A, the shoulder strap may include webbing seams 505 that are hidden behind the straps. In addition, FIG. 6B shows a perspective from a user facing a single pocket seam 217 on the left side of the tote bag and the seam 217 is only located on one side of the tote bag. Also shown on FIGS. 6A and 6B are top binding 503, bottom tape fabric 502, outer top tape fabric 501, and the base 215. The various seams, stitching and binding patterns are also shown on the example tote bag in FIGS. 6A and 6B.

Figure 7B:
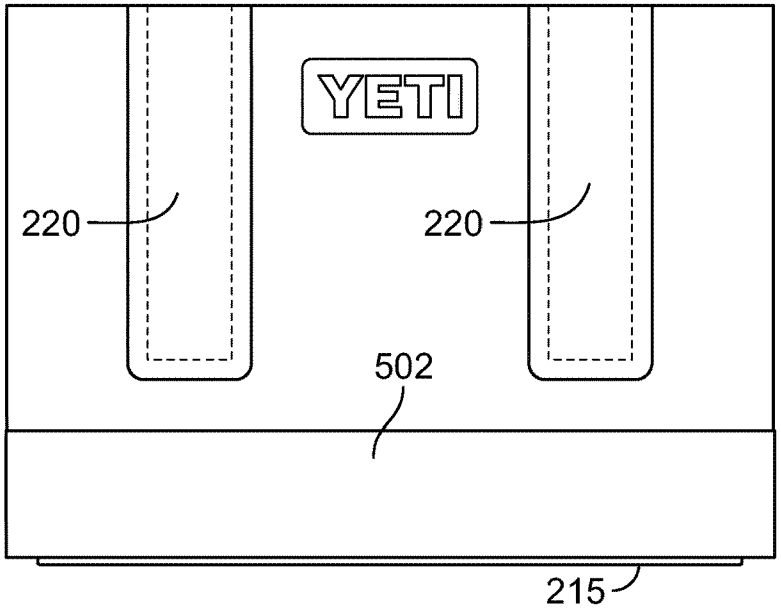
FIGS. 7A-B show a front view of another exemplary tote bag and illustrate a schematic of an enlarged portion of the bag.
Figure 7A:
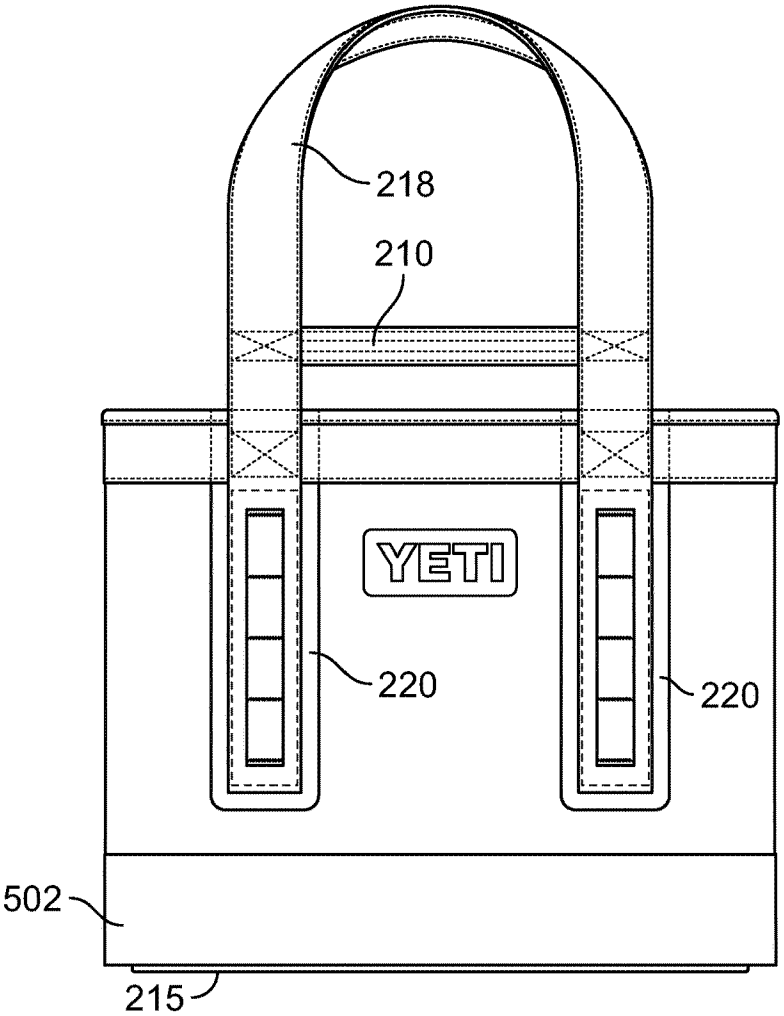

In one example, as shown in FIGS. 7A-B, the tote bag includes shoulder straps 218 and hand straps 210. The shoulder straps are attached to reinforcing patch 220 and the patch 220 is welded to the outer shell. In one example, the reinforcing patch 220, as depicted in FIGS. 7A-B, extends upwards and below the top binding 503. The reinforcing patch 220 can include a 0.25 cm, 0.5 cm, 0.75 cm, 1.0 cm, 1.5 cm, 1.75 cm, or 2.0 cm weld around a perimeter of the patch.

Figure 8A:
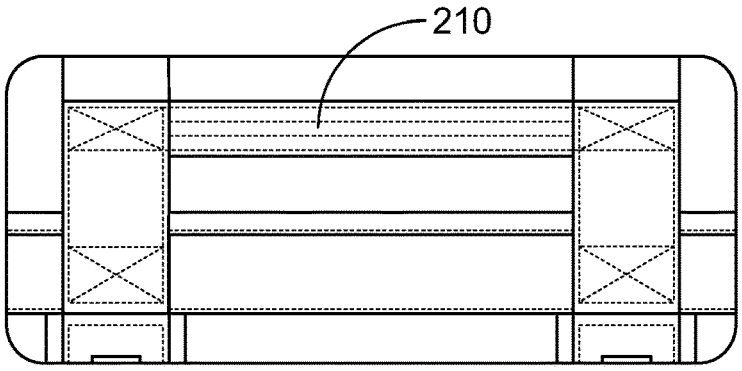
FIG. 8A shows an alternate front perspective view an exemplary hand strap for the example tote bag of FIGS. 7A-B.
Figure 8B:
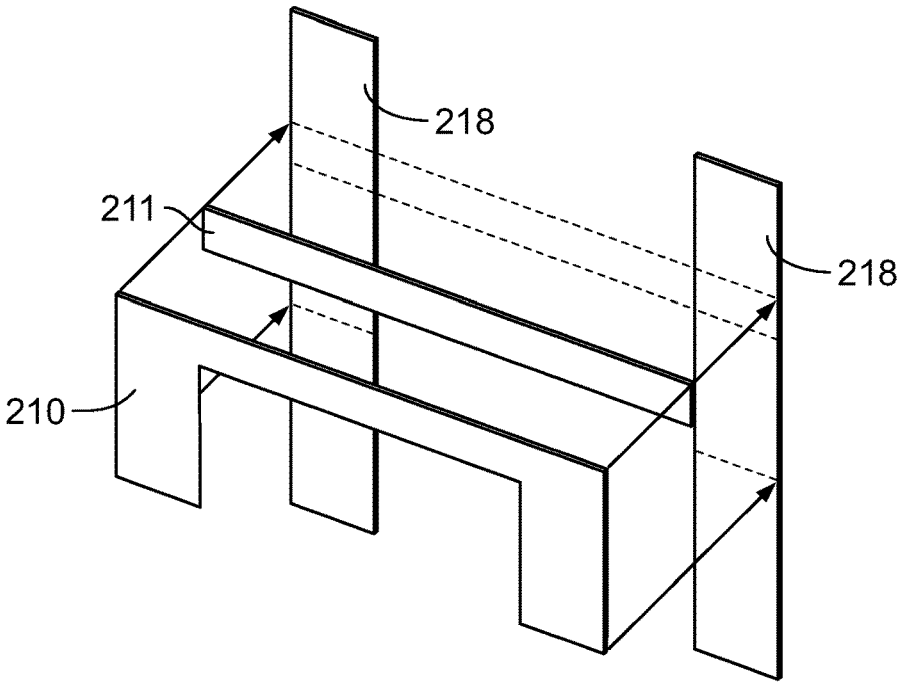
FIG. 8B shows a schematic exploded view of an exemplary hand strap for the example tote bag of FIG. 8A.
Figure 8C:
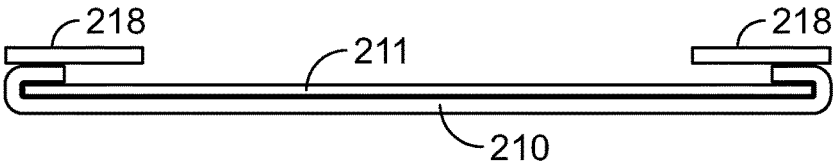
FIG. 8C shows a cross-sectional view of the strap construction of FIG. 8B.
Figure 8D:
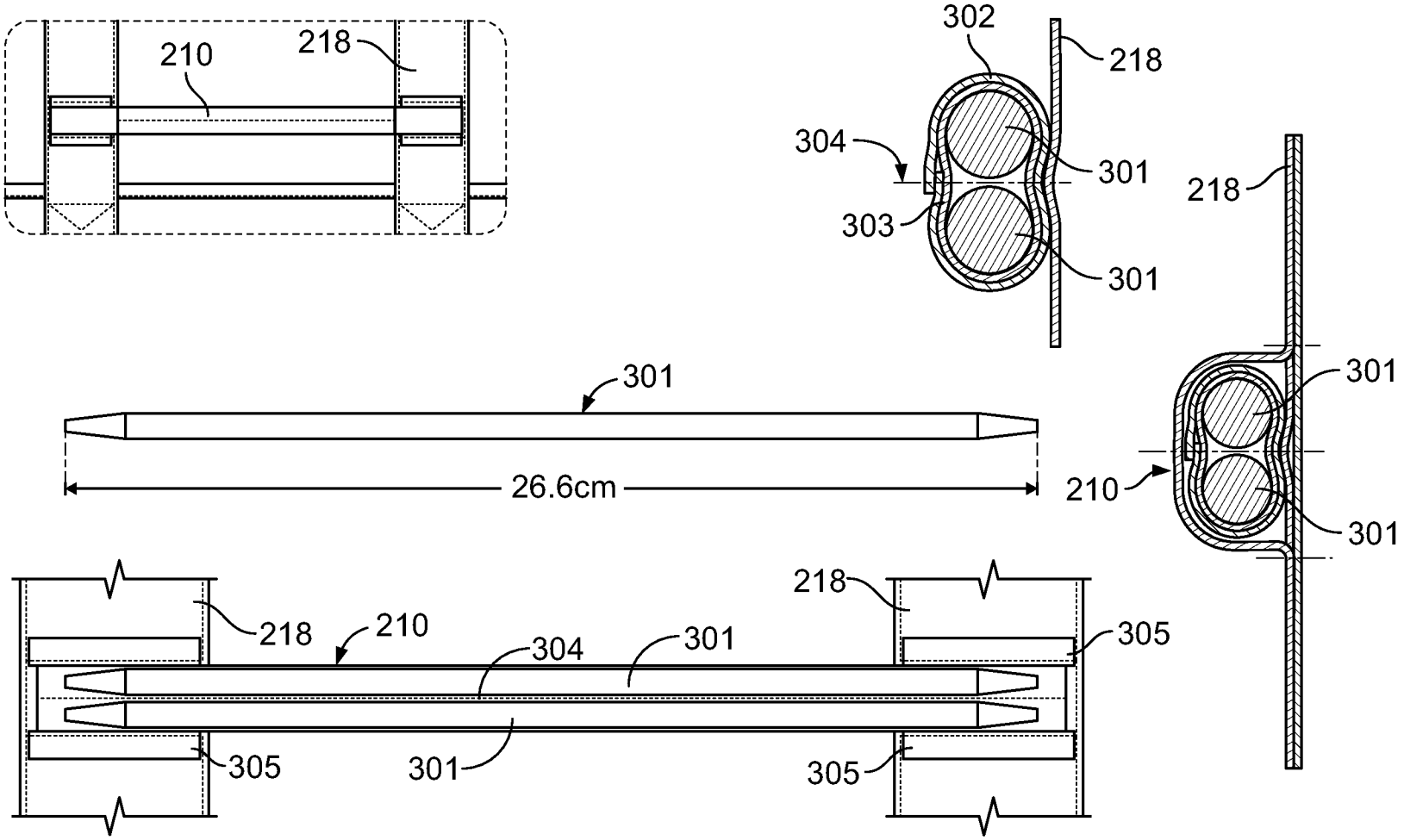
FIG. 8D is an expanded cross-sectional view of an alternative strap construction.

In another example, as shown in FIGS. 8A-8C, the tote bag includes shoulder straps 218 and hand straps 210. The straps are constructed by binding three materials or sections of nylon webbing together that include the outer shoulder strap 218, bound to the hand strap 210 facing toward the inside of the tote bag, and a middle hand strap reinforcement layer 211. In another example, as shown in FIG. 8C, the shoulder strap 218 is at least a 50 mm×1.5 mm nylon webbing, the hand strap reinforcement layer 211 is at least a 25 mm×2 mm nylon webbing, and the hand strap 210 is uncoated nylon. See Table 1. In another example, as shown in FIG. 8D, an alternative hand strap 210 construction includes an internal rigid or semi-rigid support rod 301 to thicken and strengthen the hand straps 210 attached to the shoulder straps 218. In the expanded cross-section view, one or two rods 301 are contained within a layer of webbing 303 forming the hand strap 210. In another example, the rods 301 are contained within a layer of webbing 303 surrounded by another layer of webbing 302 forming the hand strap 210. In another example, stitching 304 sewn between the rods separate the rods 301. The rod 301 may be constructed of foam, polypropylene, neoprene, polyester, Dyneema, Kevlar, cotton fabric, leather, plastics, rubber, wood, metal, or rope. In yet another example, hand strap 210 is secured by stitching, adhesive, or polymer welding to tabs 305 which are secured to shoulder strap 218 by stitching, adhesive, or polymer welding.

Figure 9:
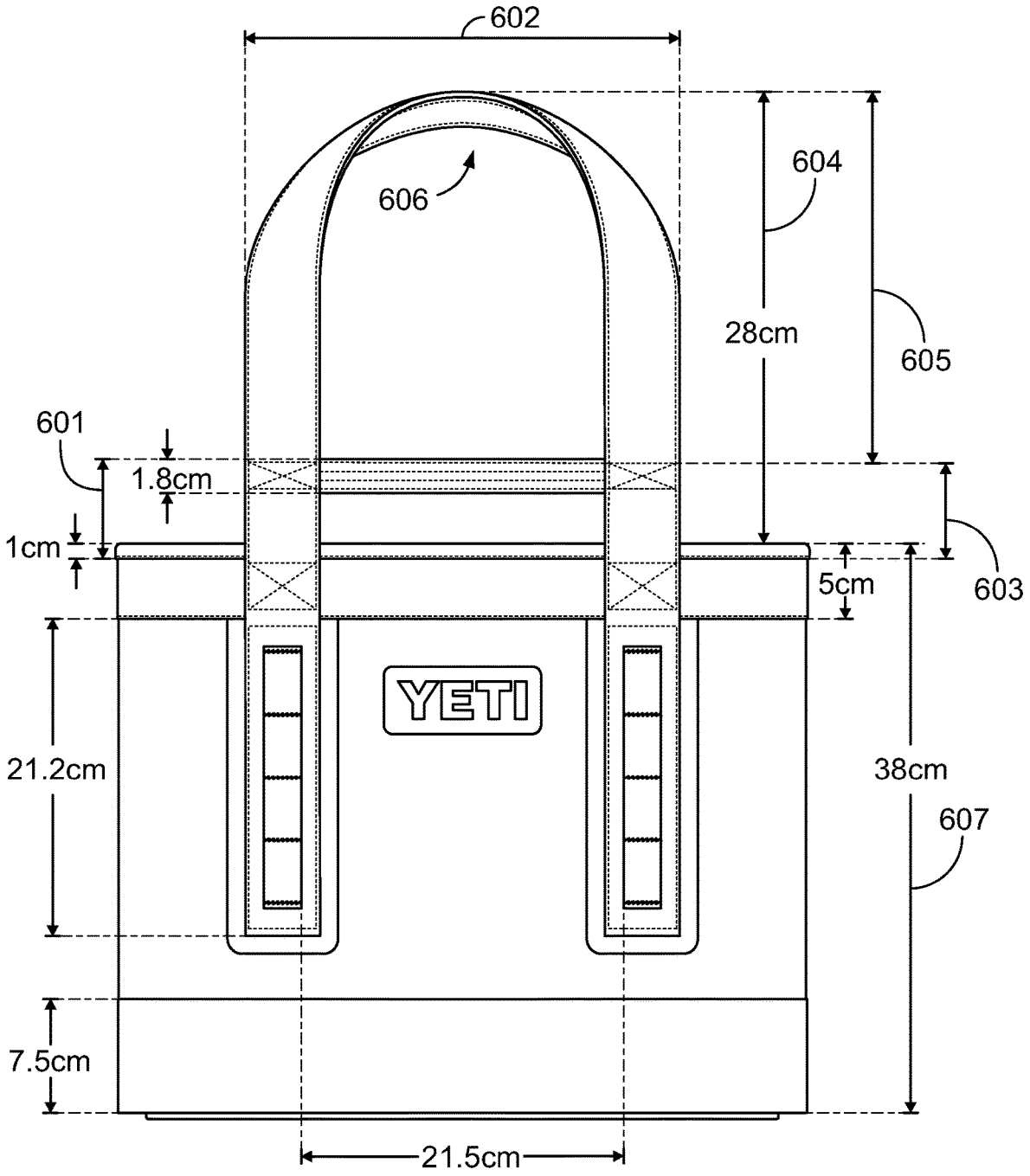
FIG. 9 illustrates another schematic of an example tote bag including proposed dimensions of on particular embodiment.
Figure 10:
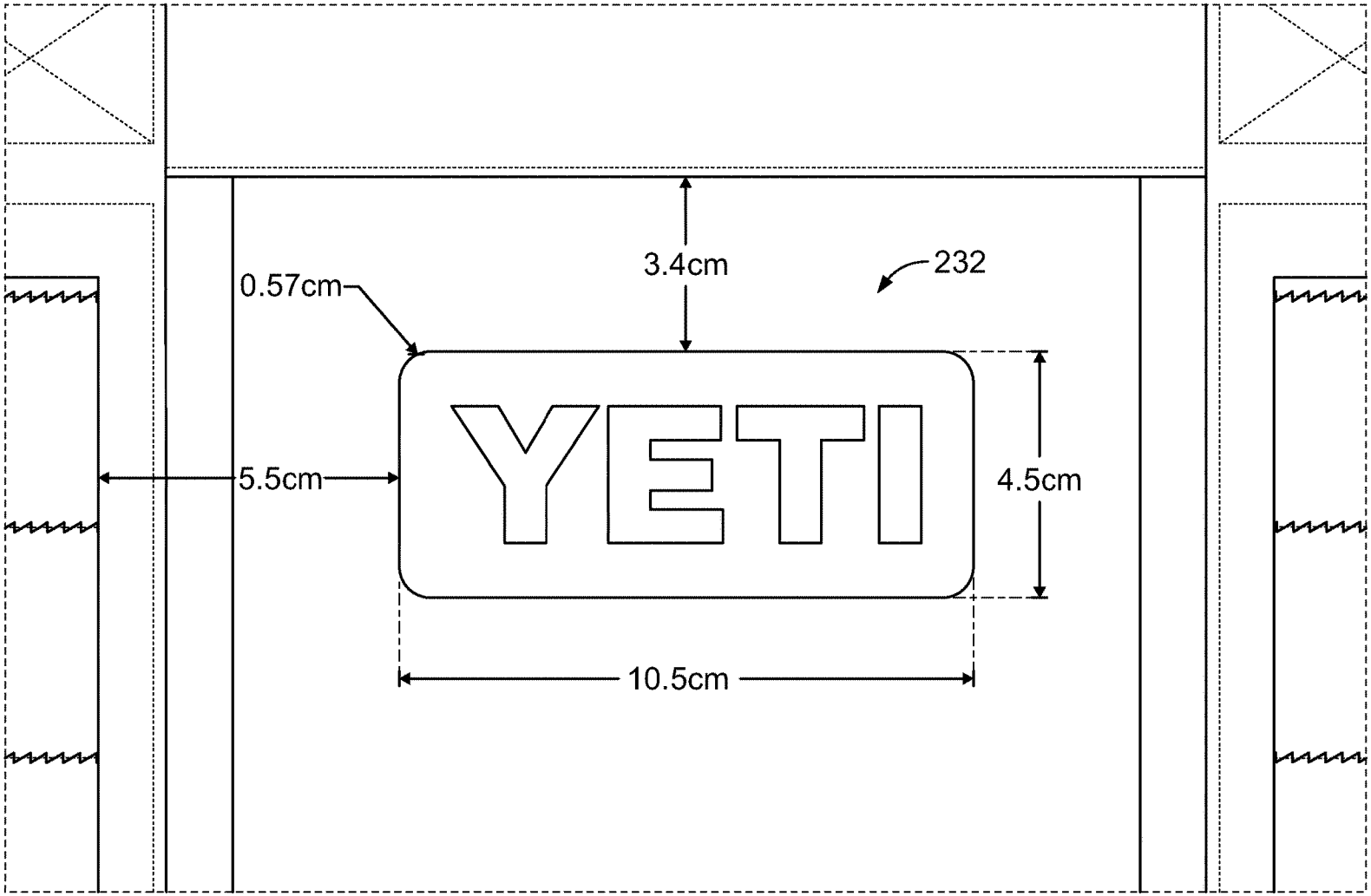
FIG. 10 shows a schematic exploded front-view of the exemplary tote bag of FIG. 9.

In yet another example, as shown in FIGS. 9 and 10, the tote bag may consist of various dimensions. In one example, the shoulder straps are configured to remain above a horizontal plane of the base when the tote bag is carried by the hand straps. In another example, the hand straps 210 may each include a first vertical portion 601, a second horizontal section 602, and a third vertical portion 603 to form a U-shape, and in one example, at least the first vertical portion and the second vertical portion are attached to the shoulder straps 218. In another example, the shoulder straps 218 may define a first length 604 above the opening of the tote bag, and the hand straps 210 may be positioned below a midpoint along the first length of the shoulder straps 218. In still another example, the shoulder straps 218 define an upper handle 606 and the hand straps 210 define a lower handle and wherein a distance between the upper handle and the lower handle is a second length 605, the second length being less than the first length. In this example, the second length 605 may be less than a height of the bag 607. In yet another example, the length 604 of the shoulder straps 218 is less than a height of the bag 607. In still another example, the shoulder strap 218 is at least 70% of a bag height. In one particular example, the tote bag includes a width and a height, wherein the width is at least 65% of the bag height. The outer shell 216 may include a certain design 232 such as a logo or name that can be attached, molded, or embossed directly into the material.

Figure 11A:
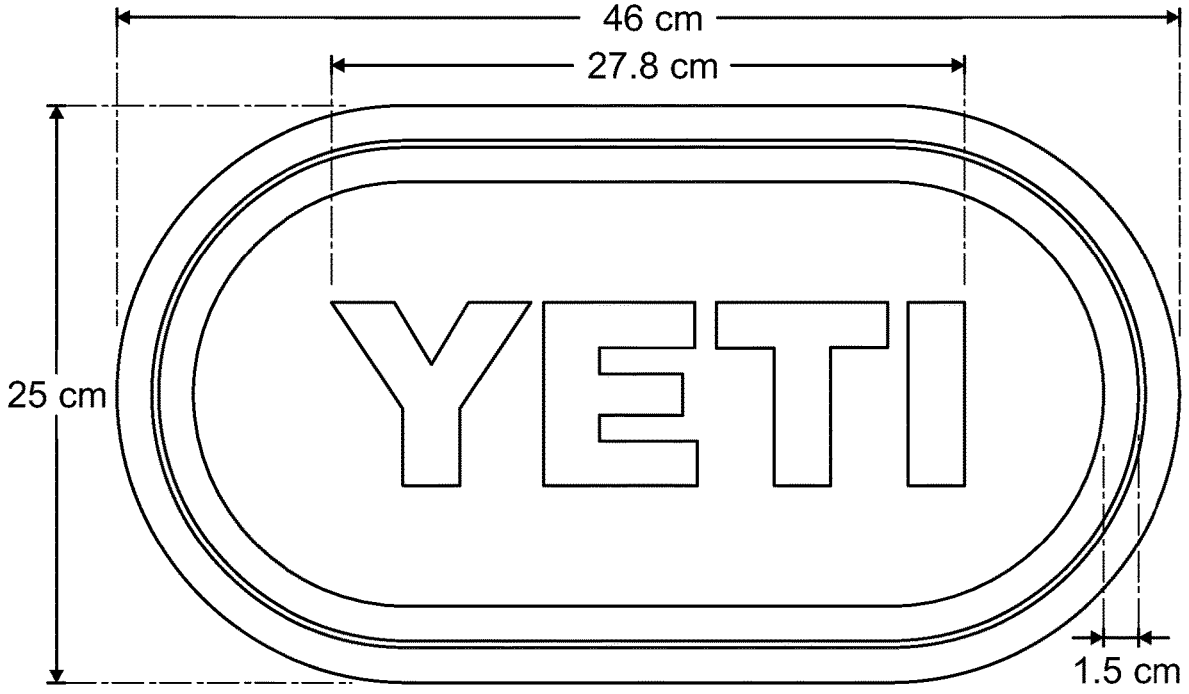
FIG. 11A shows an alternative bottom view of another exemplary tote bag.
Figure 11B:
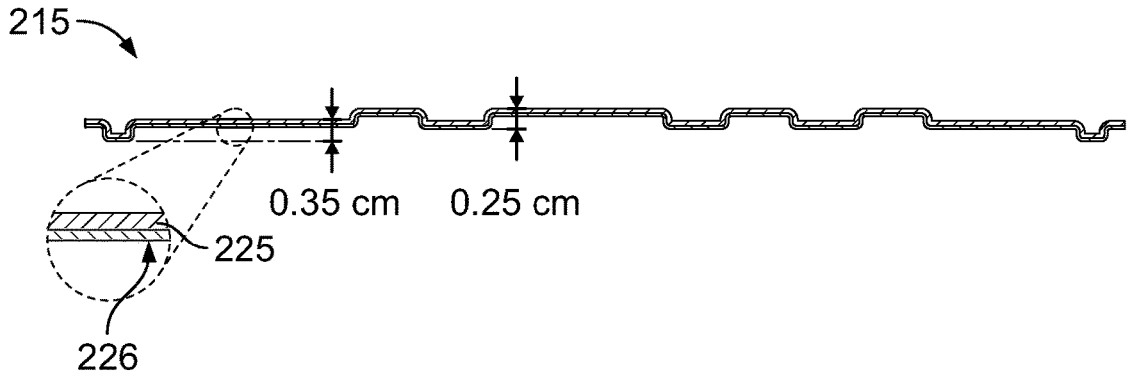
FIG. 11B illustrates a schematic of an enlarged portion of a cross-sectional view of the semi-rigid base of FIG. 11A.
Figure 12B:
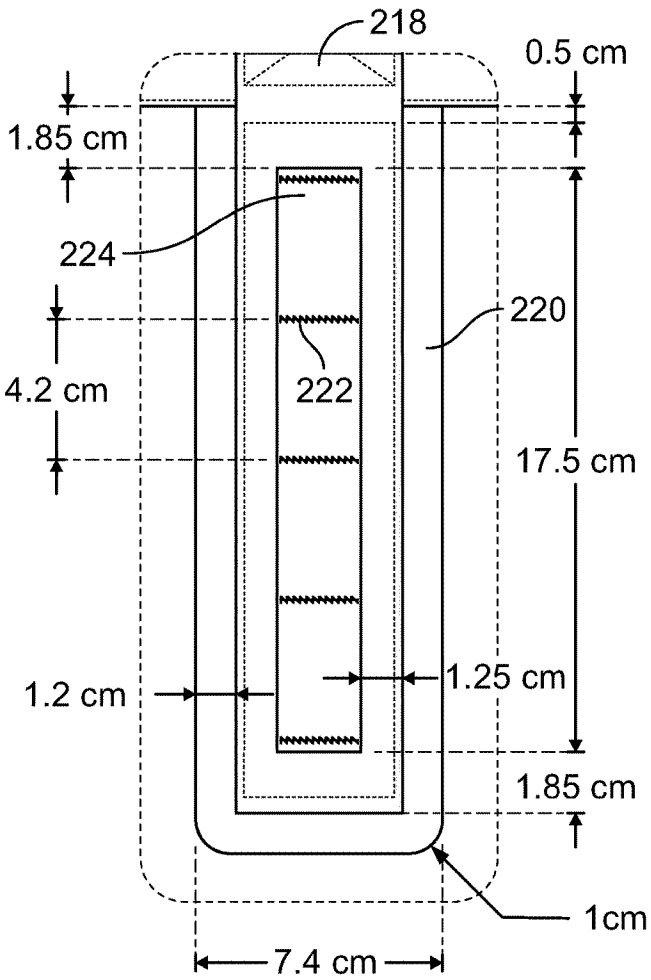
FIGS. 12A-B show a front view of another exemplary tote bag and illustrate a schematic of an enlarged portion of the bag including the MOLLE loops.
Figure 12A:
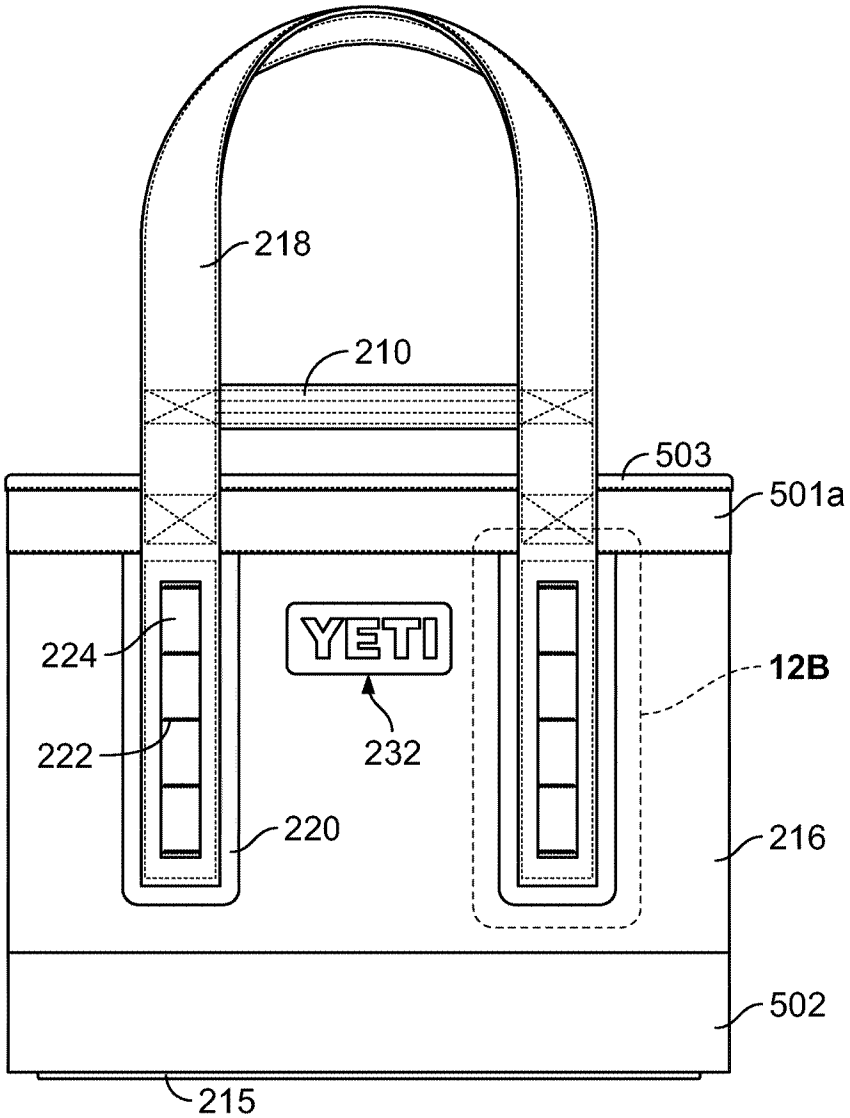

Additionally, as depicted in FIGS. 11A and 11B, the bottom portion of the tote bag can include a base 215, which adds to the structural integrity of the tote bag. The base 215 may also provide additional protection around the bottom of the tote bag. In one example, a portion of the base 215 can be formed from EVA foam 225. The base 215 may include a certain design such as a logo or name that can be molded or embossed directly into the material. The base 215 may also include base outer shell 226 constructed of 1680D nylon with single side PU or other suitable material. Additionally, the bottom tape fabric 502 may be a nylon, wherein the nylon is a double-sided and at least one color TPU. See Table 1.

Figure 13B:
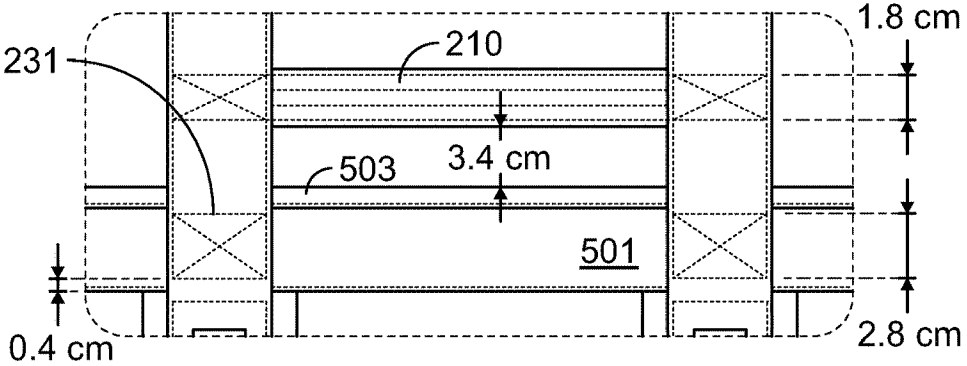
FIGS. 13A-B show a front view of another exemplary tote bag and illustrate a schematic of an enlarged portion of the bag including the hand straps.
Figure 13A:
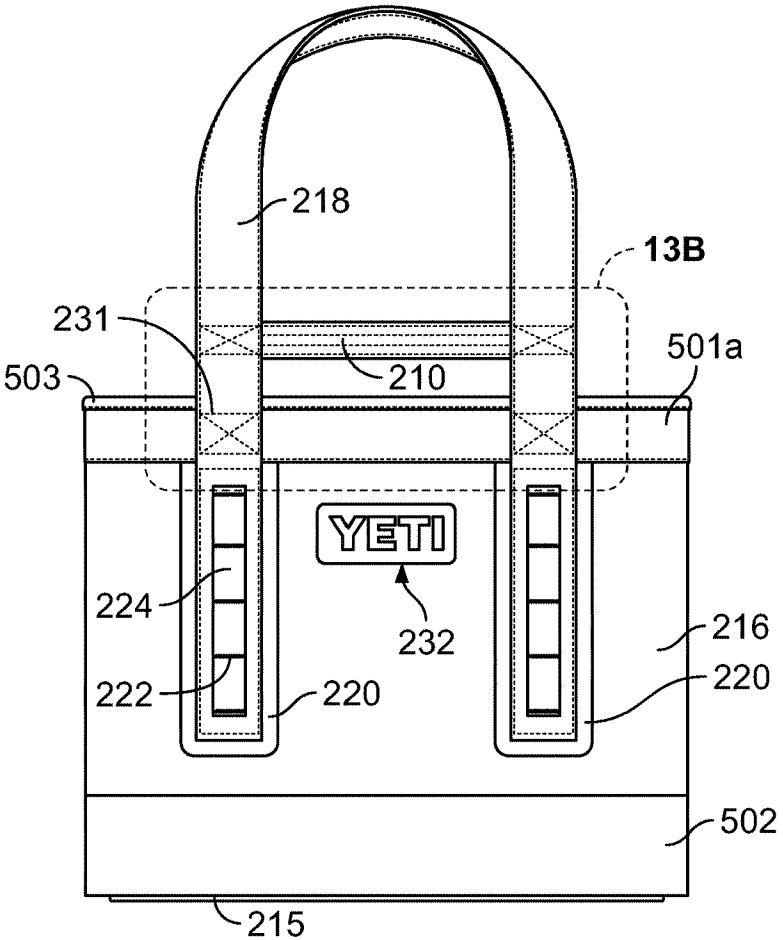

In yet other examples, as shown in FIGS. 12-14A-C, the tote bag may consist of various dimensions. In other examples, the storage compartment 504 has a capacity of at least 20 L. In still other examples, the tote bag includes a storage compartment with 5 L, 10 L, 15 L, 20 L, 25 L, 30 L, 35 L, 40 L, 45 L, or 50 L capacities. In other examples, as shown in FIGS. 14A and 14C, the tote bag includes an interior or exterior closure device 235*a* and 235*b* attached to inner top tape fabric 501*b*. The closure device 235*a* and 235*b* may be constructed of a metal, alloy, composite, ceramic, plastic, or other suitable materials.

As shown in FIGS. 13A-B, the hand straps 210 each include a first vertical portion, a second horizontal section, and a third vertical portion to form a U-shape and wherein at least the first vertical portion and the second vertical portion are attached to the shoulder straps 218. The tote bag also includes shoulder strap 218, a top binding 503 over the top tape fabric 501*a* and 501*b*. Also integrated on the shoulder strap 218 and on the front of the outer shell 216 are MOLLE loops 224. The various bindings or stitching is shown in the expanded views of FIGS. 12A-B and 13A-B. This includes stitching or bar tacks 222 as well as back tacks 231 and hidden web seams 505. The outer shell 216 can be configured to support one or more optional handles or straps (e.g. 210, 218). In this regard, the outer shell 216 can also include multiple reinforcement areas or patches 220 that are configured to assist in structurally supporting the optional handles or straps (e.g. 210, 218). The handles or straps (e.g. 210, 218) and other attachments can be stitched using threads 222, however these threads 222 do not, in one example, extend through the outer shell 216 into the storage compartment. Rather, the threads are sewn to the patches 220, and the patches 220 can be RF welded to the outer shell 216. However, the handles or straps can be attached to the patch 220 and/or attached to the outer shell 216 using any other method disclosed herein or any known method, e.g., polymer welding, stitching, or other adhesive.

In another example, the tote bag can include two straps or carry handles 210 that are connected to the frontside of outer shell 216 of the tote bag and the backside of outer shell 216 of the tote bag. In one particular example, shoulder straps 218 can include additional padding to facilitate carrying tote bag over the shoulder. The hand straps or handles 210 provide the user with another option for grasping and carrying the tote bag in such a manner that the shoulder straps 218 will not extend below the bottom of a horizontal plane of the base 215 of the tote bag (e.g. the bottom of the bag).

Hand straps 210 may also incorporate rings, carabineers, or other attachment devices. The devices can be secured to the hand straps or carry handles 210 and by stitching, adhesive, or polymer welding and can be used to help secure or tie down the tote bag to another structure such as a vehicle, vessel, camping equipment, and the like or various objects such as keys, water bottle bottles, additional straps, bottle openers, tools, other personal items, and the like. The hand straps may also be attached to each other by incorporating various sealing or connecting devices, for example, hook and loop, buttons, snaps, buckles, or zippers, seals, metal or plastic clamps, and combinations thereof.

Additionally, as shown in FIGS. 13A-B, webbing formed as loops or MOLLE loops 224 can be sewn onto the shoulder straps 218, that also forms the hand straps 210, on the back of the tote bag. Again, the MOLLE loops 224 can be used to attach items (e.g., carabineers, dry bags) to the tote bag. The hand straps 210 can also provide the user with another option for securing the tote bag to a structure.

In one example, the hand straps 210 and shoulder straps 218 and MOLLE loops 224 can be constructed of nylon webbing. Other materials may include polypropylene, neoprene, polyester, Dyneema, Kevlar, cotton fabric, leather, plastics, rubber, or rope. The hand straps 210 and shoulder straps 218 can be attached to the outer shell 216 or the reinforcement patches 220 by stitching, adhesive, or polymer welding. The MOLLE loops 224 can be configured to receive many types of items or a corresponding group of hooks, which can be placed onto the surface anywhere on various items, such as fishing lures, keys, bottle openers, card holders, tools, other personal items, and the like. In still another example, the outer shell 216 includes a patch or logo 232 that can include a logo, company name, personalization, or other customization. The patch or logo 232 can be washable and UV resistant to prevent discoloration.

In a particular example, the polymer welding technique includes both external and internal methods. External or thermal methods can include hot gas welding, hot wedge welding, hot plate welding, infrared welding and laser welding. Internal methods may include mechanical and electromagnetic welds. Mechanical methods may include spine welding, stir welding, vibration welding, and ultrasonic welding. Electromagnetic methods may include resistance, implant, electrofusion welding, induction welding, dielectric welding, RF (Radio Frequency) welding, and microwave welding. The welding can be conducted in a flat or horizontal plane to maximize the effectiveness of the polymer welding to the construction materials. As a result, a rugged watertight seam can be created that prevents water or fluids from escaping from or into the storage compartment 504.

In one particular example, the outer shell 216 and bottom inner liner 219 can be constructed from double laminated TPU nylon fabric. Nylon fabric can be used as a base material for the bottom inner liner 219 and the outer shell 216 and can be coated with a TPU laminate on each side of the fabric. The TPU nylon fabric used in one particular example is 0.1 to 1.0 millimeters thick, is waterproof, and has an antimicrobial additive that meets all Food and Drug Administration requirements. However, it is contemplated that the fabrics used to construct the tote bag incorporate antimicrobial materials to create a mildew-free environment that is food contact surface safe. In one specific example, the nylon can be 840d nylon with TPU. Alternative materials used to manufacture the inner bottom liner 219 and outer shell 216 include PVC, TPU coated nylon, coated fabrics, and other weldable and waterproof fabrics. See Table 1.

The foam base 223 can be manufactured from an NBR/PVC blend or any other suitable blend. In addition, the tote bag may also include the compression molded EVA 225 with a TPU coated nylon laminate 226 layer. The compression molded EVA 225 may be substituted with foam, plastic, metal or other material. In one example, the base 215 is at least 6 mm thick. Additionally, as shown in FIGS. 4A-B and Table 1, the compression molded EVA 225 and foam base 223 can each be 3 mm thick. Although the base outer shell 226 is laminated to the compression molded EVA 225, in an alternative example, the base outer shell 226 can be attached to the bottom of the compression molded EVA 225 by co-molding, polymer welding, adhesive, or any known methods.

Figure 15:
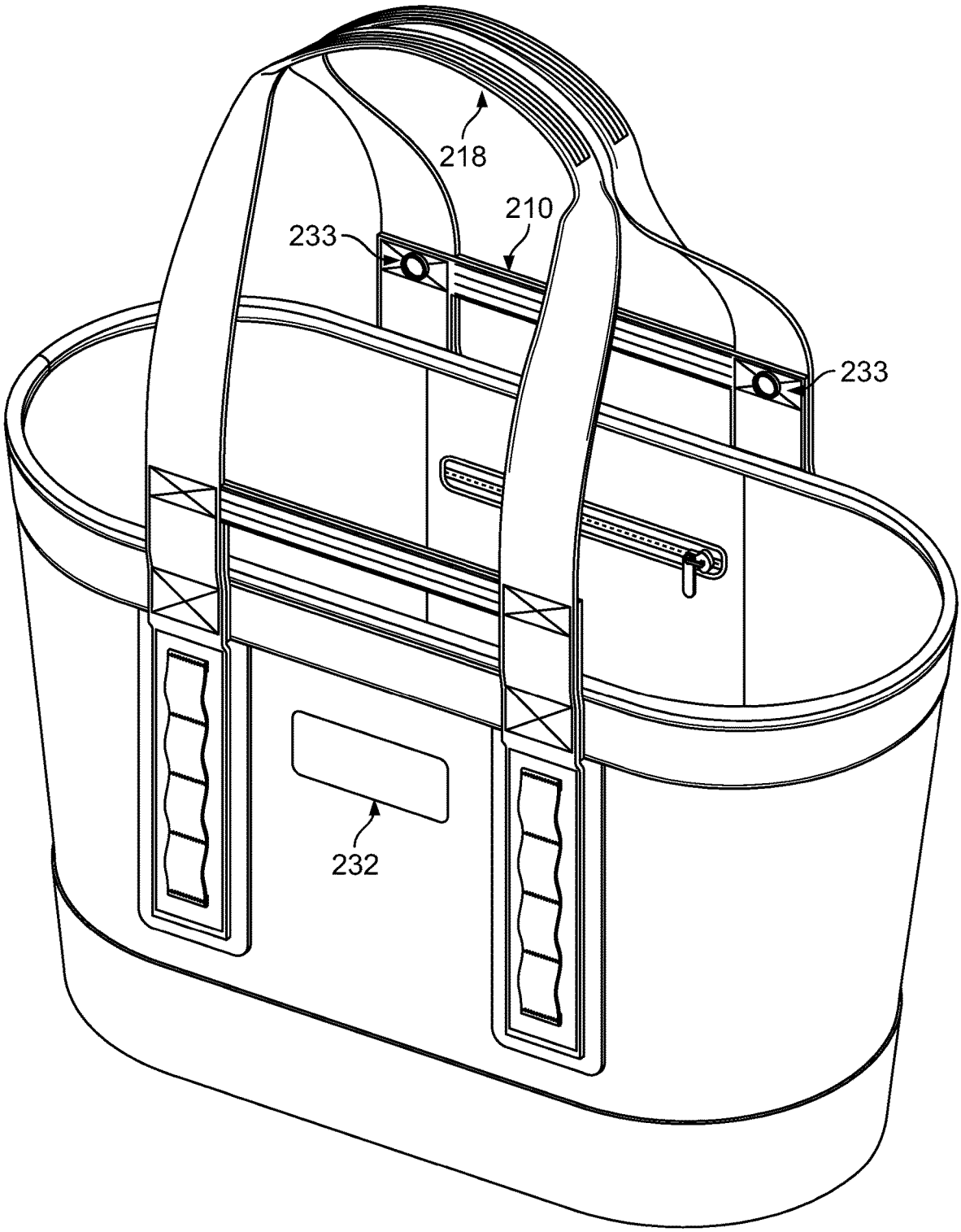
FIGS. 15-21 show various perspective views of another example tote bag.
Figure 16:
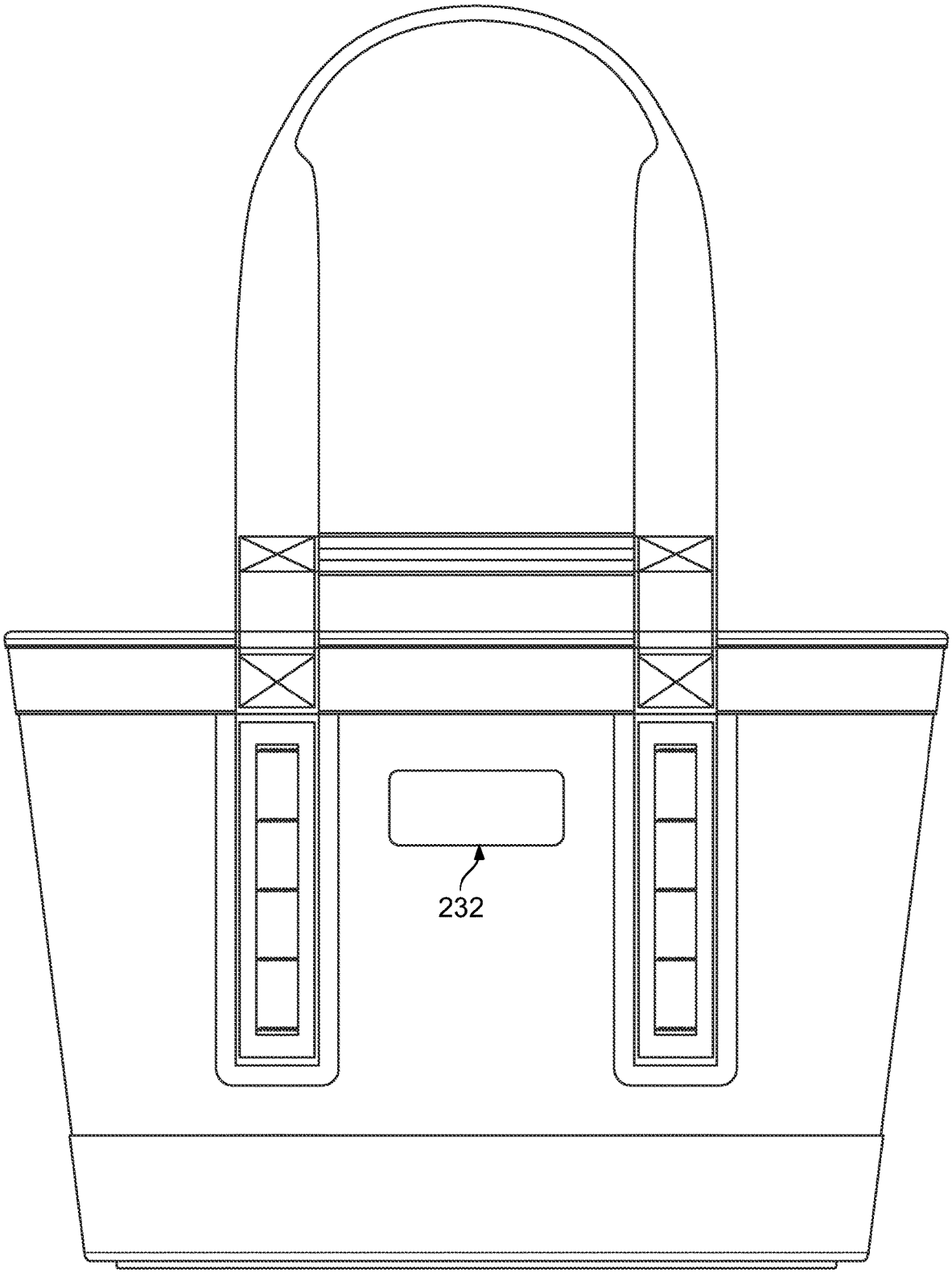
Figure 17:
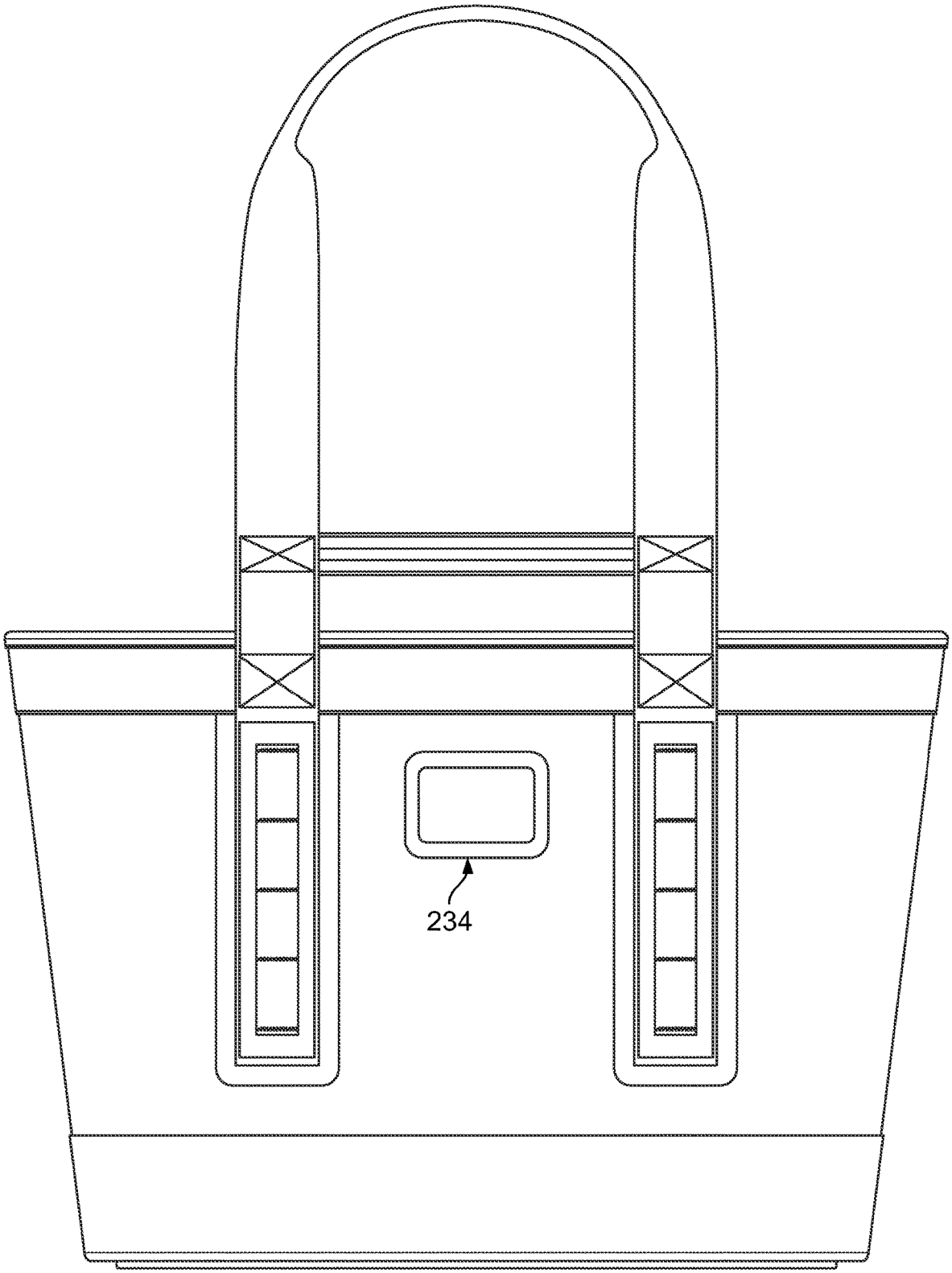
Figure 18:
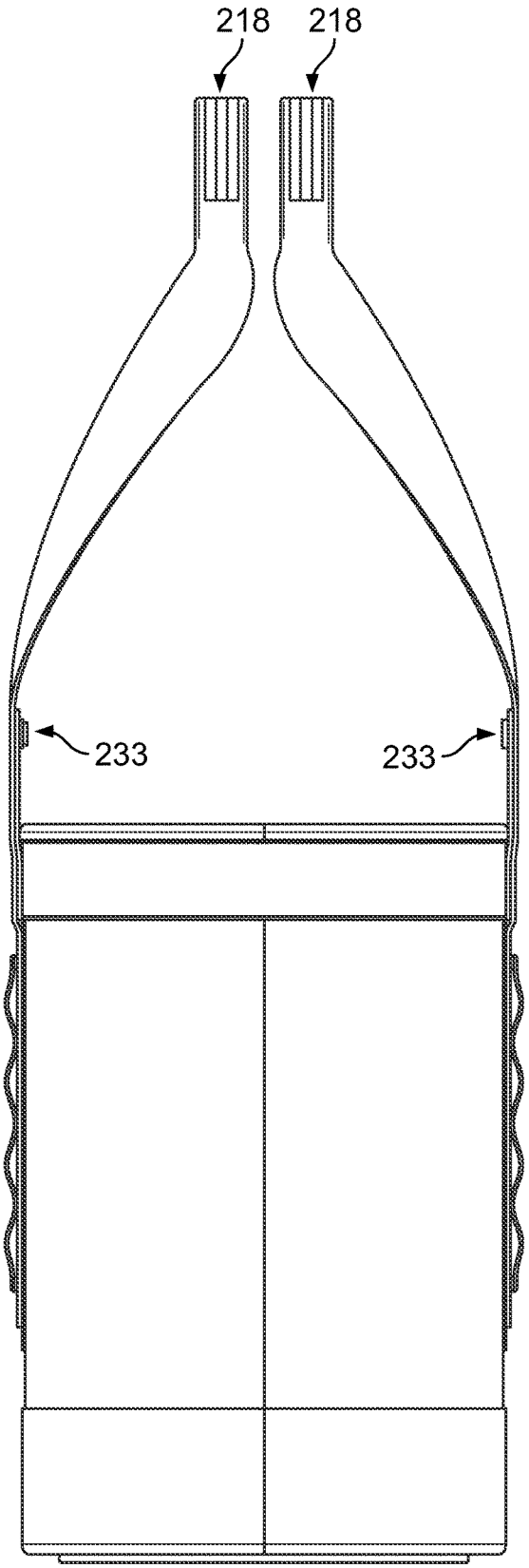
Figure 19:
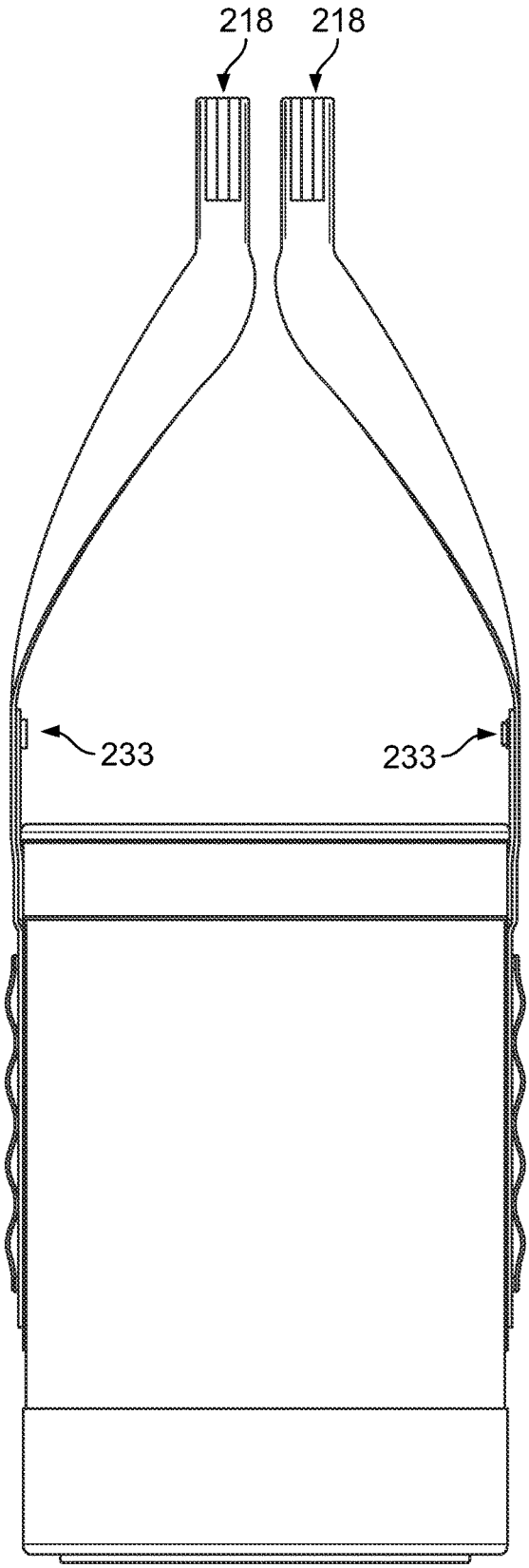
Figure 20:
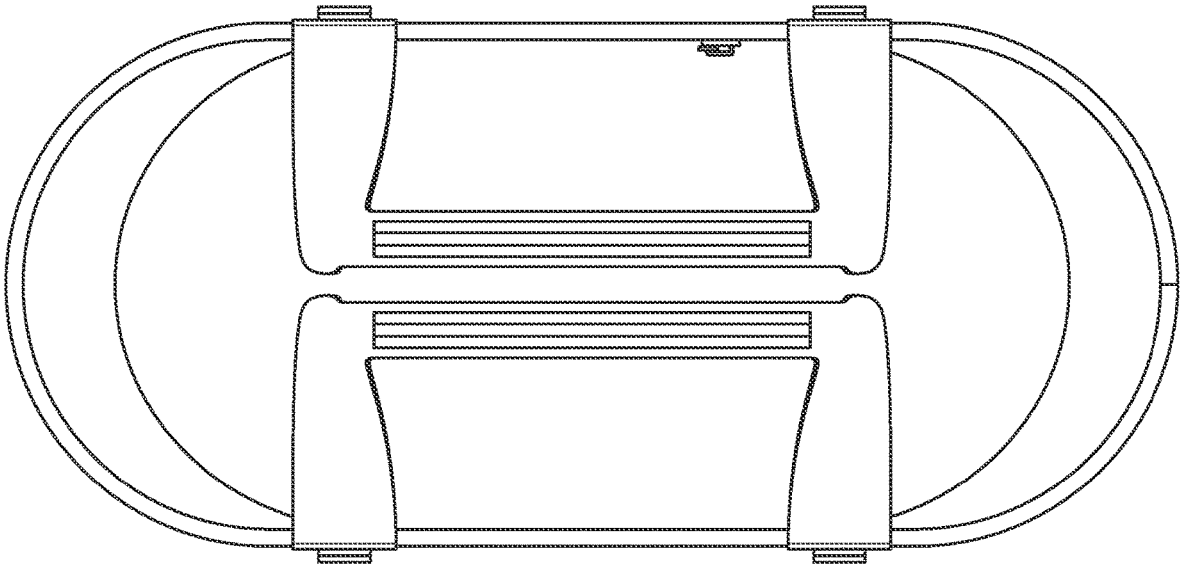
Figure 21:
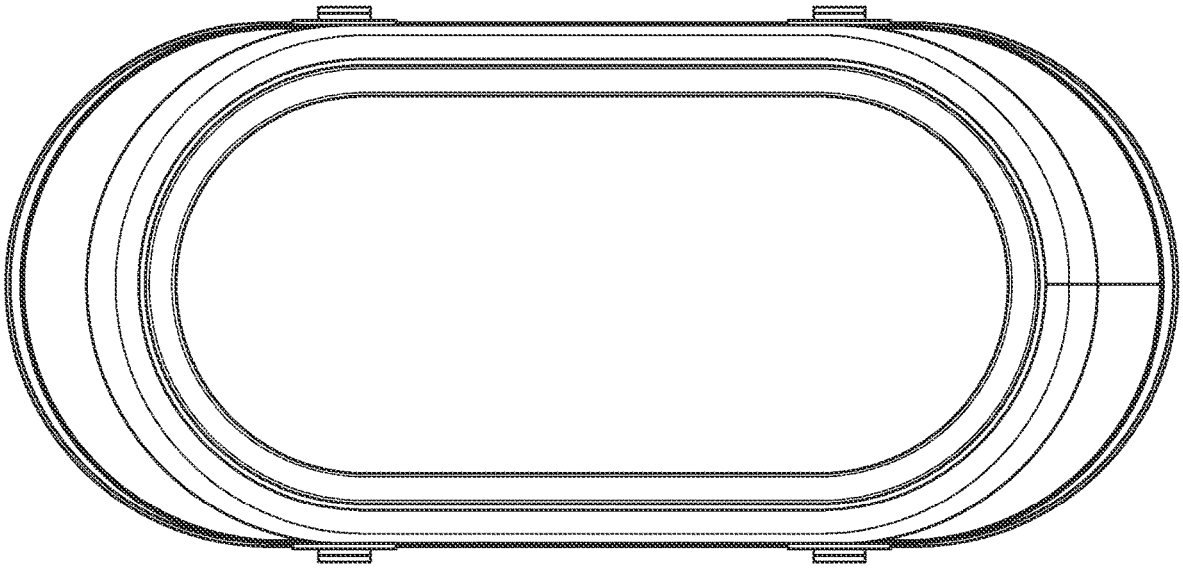

FIGS. 15-21 show an alternative example of a tote bag, which may have the same construction and functionality described above, but can have a different shape or configuration. In one example, as shown in FIGS. 16 and 17, the tote bag may have a trapezoid shape or configuration. In still other examples, the tote bag may be tapered from the top of the bag to the bottom of the bag. Additionally, as shown in FIGS. 15, 18, and 19, the tote bag can be provided with snaps 233 for securing each set of straps (i.e. 210, 218) to each other. This facilitates the ease of carrying the bag by the lower handles. As shown in FIGS. 16 and 17, the outer shell 216 may include a certain design or patch 232 such as a logo or name that can be attached, molded, or embossed directly into the material, and may be removable (i.e. from a hook and loop patch 234). The design or patch may be attached by welding, stitching, adhesive, or secured by other methods. The design or patch 232 may be attached, for example, by hook and loop, buttons, snaps, buckles, zippers, seals, metal or plastic clamps, and combinations thereof so that it may be removed. The tote bag may have a design or patch 232 on a single side of the bag on the outer shell 216 or on both sides of the tote bag as shown in FIGS. 16 and 17. In still other examples, the design or patch may be permanently affixed to one or both sides of the tote bag. In other examples, the design or patch may be in a removable configuration on one or both sides of the tote bag. In yet other examples, one side of the tote bag includes a permanently affixed design or patch and the other side may include a removable design or patch. In other examples, the design or patch 232 may be configured to include a pocket that allows a user to insert a luggage label, business card, or identification tag that includes personal or other contact information such as name, address, email address, phone numbers, etc.

In another example, a method of forming a tote bag may include forming a tote bag by forming an outer shell, placing a bottom inner liner into the outer shell, and securing the bottom inner liner to the outer shell thereby forming a storage compartment. The method can also include forming a semi-rigid base that is constructed from a compression molded EVA, a PE foam base, and a base outer shell constructed of a TPU coated nylon laminate that covers the semi-rigid base. The method can also include securing the base outer shell to the outer shell and binding several straps to the outer shell.

The method can also include a binding material that is nylon and the binding material is stitched to an outer shell/reinforcing patch and the patch is then welded to the outer shell. The method can also include forming an inner bottom liner that is welded to the outer shell, and the outer shell and the base outer shell are welded to a bottom tape fabric.

The method can also include forming the insulating layer at least partly of a first rectangle and a second rectangle and forming the first rectangle of a larger area than the second rectangle. The method can also include securing the bottom inner liner to the lower outer shell by a weld. The method can also include forming a first pocket, that includes a zipper, that is welded to the outer shell inside the storage compartment and forming a second pocket that is welded to the outer shell inside the storage compartment opposite the first pocket.

An example method may include forming an outer shell with a single vertical seam. Another example method includes attaching or securing straps to multiple reinforcing patches that are then welded to the outer shell. The method can also include attaching multiple MOLLE loops to the straps. The method can also include forming straps by binding three nylon strap components together and then binding the straps to the plurality of patches welded to the outer shell. The method can also include forming portions of the semi-rigid base by injection molding.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

What is claimed is:

1. A tote bag comprising:

an outer shell comprising a top, a bottom, an opening, a front, a back, a right side, and a left side, wherein the outer shell is waterproof and flexible, and wherein the outer shell comprises a seam;

a base outer shell defining a bottom of the bag, wherein the outer shell and a bottom inner liner form a storage compartment, and wherein the opening is configured to allow access to the storage compartment, the storage compartment further comprising, an inner pocket attached to an interior of the bag comprising a zipper, wherein the zipper is configured to open and close the inner pocket;

the bottom inner liner attached to the bottom of the outer shell, and a foam layer positioned between the bottom inner liner and the base outer shell;

an interior closure device;

a plurality of reinforcement patches;

a top binding positioned over an edge of the top of the outer shell;

a top material extending underneath and below the top binding and configured to surround an upper portion of an exterior of the outer shell; and a plurality of straps, wherein a first portion of the straps includes padding; and wherein a second portion of the plurality of straps is attached to a portion of the plurality of reinforcement patches, wherein the plurality of reinforcement patches are attached to the outer shell.

2. The tote bag of claim 1, wherein the tote bag is water resistant and may be cleaned by flushing with water.

3. The tote bag of claim 1, wherein the plurality of reinforcement patches is sewn or welded to the outer shell.

4. The tote bag of claim 1, further comprising a second inner pocket attached to the interior of the bag and comprising a second zipper, wherein the second zipper is configured to open and close the second inner pocket.

5. The tote bag of claim 4, wherein the second inner pocket is welded to the interior of the bag.

6. The tote bag of claim 1, wherein the closure device is a metal, an alloy, a composite, a ceramic, or a plastic.

7. The tote bag of claim 1, further comprising a bottom strip of material positioned on a lower portion of the outer shell and a portion of the base.

8. The tote bag of claim 1, wherein at least one of the plurality of straps includes a plurality of webbing formed as loops for the attachment of items.

9. The tote bag of claim 1, wherein the closure device is positioned underneath and extends below the top binding.

10. The tote bag of claim 1, wherein the seam is on one side of tote bag.

11. The tote bag of claim 10 wherein the seam is on the left side of the tote bag.

12. The tote bag of claim 1, wherein the storage compartment has a capacity of at least 30 liters.

13. A tote bag comprising:

an outer shell comprising a sidewall having a single vertical seam, and forming a top, a bottom, an opening, a front, and a back;

a bottom inner liner attached to the bottom of the outer shell;

a semi-rigid base defining a bottom of the bag, wherein the outer shell and the bottom inner liner form a storage compartment, and wherein the opening is configured to allow access to the storage compartment; an inner pocket attached to an inner portion of the sidewall wherein the inner pocket comprises a zipper, wherein the zipper is configured to open and close the inner pocket; and a foam layer positioned between the bottom inner liner and the base;

a closure device;

a plurality of reinforcement patches;

a top binding positioned over an edge of the top of the outer shell;

a top material extending underneath and below the top binding and configured to surround an upper portion of an exterior of the outer shell; and a bottom strip of material, wherein the bottom strip of material covers a portion of the outer shell and a portion of the base, and wherein the bottom strip of material is configured to wrap around a bottom perimeter of the shell; and a plurality of straps wherein a portion of the straps is attached to a portion of the plurality of reinforcement patches, wherein the plurality reinforcement patches are attached to the outer shell.

14. The tote bag of claim 13, wherein the base is substantially rectangular shaped or substantially oval shaped.

15. The tote bag of claim 14, wherein the base includes a logo embossed in a bottom of the base.

16. The tote bag of claim 13, wherein the vertical seam is positioned on a side of the tote bag.

17. The tote bag of claim 13, wherein the reinforcement patches are sewn or welded to the outer shell.

18. The tote bag of claim 17, wherein at least one of the plurality of straps includes a plurality of webbing formed as loops for the attachment of items.

19. The tote bag of claim 13, wherein the closure device is a metal, an alloy, a composite, a ceramic, or a plastic.

20. The tote bag of claim 13, further comprising a second inner pocket welded to a second inner portion of the sidewall comprising a second zipper, wherein the second zipper is configured to open and close the inner pocket, and wherein the second inner pocket is waterproof.

21. The tote bag of claim 13, wherein the inner pocket zipper comprises a length extending horizontally and wherein the length is greater than a distance between a portion of a first reinforcement patch of the plurality of reinforcement patches to a portion of a second reinforcement patch of the plurality of reinforcement patches.

22. The tote bag of claim 13, wherein the semi-rigid base is configured to keep the tote bag upright with or without contents in the storage compartment.

23. A tote bag comprising:

an outer shell comprising a sidewall defining a top, a bottom, an opening, a front, and a back;

a plurality of straps;

a bottom inner liner attached to the bottom of the outer shell;

a base defining a bottom of the bag;

a foam layer positioned between the bottom inner liner and the base, wherein the outer shell and the bottom inner liner form a storage compartment, and wherein the opening is configured to allow access to the storage compartment;

an inner pocket attached to an inner portion of the sidewall, wherein the inner pocket comprises a zipper, and wherein the zipper is configured to open and close the inner pocket;

a top binding positioned over an edge of the top of the outer shell;

a top material extending underneath and below the top binding and configured to surround an upper portion of an exterior of the outer shell; and a closure device, wherein the closure device is secured to a first loop, and wherein the closure device is configured to engage a second loop.

24. The tote bag of claim 23, wherein the outer shell includes at least one a seam.

25. The tote bag of claim 24, wherein the outer shell comprises a TPU coated fabric.

26. The tote bag of claim 23, wherein the closure device is a metal, an alloy, a composite, a ceramic, or a plastic.

27. The tote bag of claim 23, wherein the plurality of straps are affixed to the outer shell at first and second contact areas, and wherein the inner pocket zipper comprises a length greater than a distance between a portion of the first contact area to a portion of the second contact area.

* * * * *